US008063845B2

(12) United States Patent
Rabinovich

(10) Patent No.: US 8,063,845 B2
(45) Date of Patent: Nov. 22, 2011

(54) SYMMETRICAL PRINTED MEANDER DIPOLE ANTENNA

(75) Inventor: Victor Rabinovich, Richmond Hill (CA)

(73) Assignee: Flextronics Automotive Inc., Milpitas, CA (US)

( * ) Notice: Subject to any disclaimer, the term of this patent is extended or adjusted under 35 U.S.C. 154(b) by 296 days.

(21) Appl. No.: 12/232,197

(22) Filed: Sep. 12, 2008

(65) Prior Publication Data

US 2009/0066600 A1 Mar. 12, 2009

Related U.S. Application Data

(60) Provisional application No. 60/960,034, filed on Sep. 12, 2007.

(51) Int. Cl.
*H01Q 9/16* (2006.01)

(52) U.S. Cl. ..... 343/793; 343/795; 343/820; 343/713

(58) Field of Classification Search ..... 343/793, 343/795, 803, 806, 850, 852, 865, 711, 713, 343/820, 700 MS
See application file for complete search history.

(56) References Cited

U.S. PATENT DOCUMENTS

| | | | | |
|---|---|---|---|---|
| 6,590,543 | B1 | 7/2003 | Apostolos | |
| 7,190,322 | B2 | 3/2007 | Apostolos et al. | |
| 2001/0011964 | A1 | 8/2001 | Sadler et al. | |
| 2005/0030245 | A1* | 2/2005 | Croswell et al. | 343/795 |
| 2006/0170610 | A1* | 8/2006 | Rabinovich et al. | 343/895 |
| 2006/0250250 | A1 | 11/2006 | Youn | |
| 2006/0281423 | A1 | 12/2006 | Caimi et al. | |
| 2007/0164921 | A1* | 7/2007 | Hu et al. | 343/895 |

OTHER PUBLICATIONS

Rabinovich et al., Small Printed Meander Symmetrical and Asymmetrical Antenna Performances, Inlcuding the RF Cable Effect, in the 315 MHZ Frequency Band, Microwave and Optical Technology Letters/ vol. 48, No. 9, Sep. 2006, pp. 1828-1833.*

* cited by examiner

*Primary Examiner* — Dieu H Duong

(74) *Attorney, Agent, or Firm* — Patton Boggs LLP

(57) ABSTRACT

A symmetrical printed meander dipole antenna includes a dielectric board including a ground plane; a first antenna trace line disposed on a first portion of the dielectric board and in electrical contact with the dielectric board, the first antenna trace line including a plurality of first vertical meandered traces; a second antenna trace line disposed on a second portion of the dielectric board and in electrical contact with the dielectric board, the second antenna trace line including a plurality second vertical meandered traces, wherein the first and second plurality of vertical meandered traces are symmetrical to each other; and an inductor in contact with the first and second antenna trace lines for tuning the impedance of the symmetrical printed meander dipole antenna.

12 Claims, 18 Drawing Sheets

| 1: Mkr (MHz) | | Ohm | Ohm | 2: Mkr (MHz) | dB |
|---|---|---|---|---|---|
| 1: | 315.000 | 28.30 | -5.880 | | |
| 2> | 311.250 | 30.92 | -44.14 | | |
| 3: | 320.417 | 31.15 | 51.10 | | |

2000

2100

| 1: Mkr (MHz) | | Ohm | Ohm | 2: Mkr (MHz) | dB |
|---|---|---|---|---|---|
| 1: | 315.000 | 46.75 | 6.192 | | |
| 2: | 300.833 | 146.1 | -47.04 | | |
| 3> | 320.833 | 31.73 | 57.86 | | |

2300

SYMMETRICAL PRINTED MEANDER DIPOLE ANTENNA

RELATED APPLICATIONS

This application claims the benefit of U.S. Provisional Patent Application No. 60/960,034 filed on Sep. 12, 2007, the entire teachings of which are incorporated herein by reference.

BACKGROUND

In recent years, the wireless communication market has expanded greatly. Wireless devices, such as remote control engine start systems, remote keyless entry ("RKE") systems, and automatic tolling systems are now considered "classical" devices for short range vehicle wireless communication. Such control and security devices commonly operate in the 315 MHz frequency in the United States, Canada, and Japan. In these systems, the antenna is a key element in determining system size and performance. Examples of external and internal antennas that are in current production are known. As a rule, internal antennas are printed on dielectric boards together with electronic components of RKE systems, for example. The integration of radio frequency ("RF") and digital electronic components with receiving antennas reduces the number of wires and connectors, thus reducing system costs. Nevertheless, such designs have a significant disadvantage, namely parasitic emissions from electronic components (oscillators) located on the circuit board that can markedly reduce the communication range.

An external dipole antenna does not have such a disadvantage because it is isolated from the elements of the control electronics. Unfortunately, such antennas with lengths of about 30 cm are large and inconvenient for interior vehicle applications. The "pigtail" coaxial antenna described in U.S. Pat. No. 6,937,197 avoids some of the problems seen in external dipoles, and thus may be more convenient for automotive interior applications. The pigtail is made by simply stripping off the outer conductor of the coax to extend the inner conductor to a length equal to approximately a quarter-wavelength; the cable becomes a part of the antenna. One problem associated with pigtail antennas is that in automotive applications pigtail antennas are positioned very close to the car body as a part of a cable harness. Because of the metal shadows from the car body, the pigtail has very small gain; the small gain in turn causes reduced communication range. Therefore, in applications where communication range is a critical factor, pigtail antennas are not acceptable for automotive antenna applications.

Referring to FIG. 1, a conventional asymmetrical meander antenna 50 is shown, which tends to have a significant current flow in the outer conductor of the RF cable 54 that connects the asymmetrical meander antenna 50 with a control module, such as remote keyless entry (RKE") module 58. Asymmetrical meander antenna 50 includes asymmetrical trace lines 52 that are printed on a printed circuit board (PCB"). Essentially, the RF cable 54 becomes part of the asymmetrical meander antenna 50 and provides for extended signal range. A drawback of such asymmetry is that the cable location influences the communication range of the RKE system. Modern vehicles have many different electronic devices, including heaters, air conditioning modules with automatic temperature control, audio amplifier systems, heated seat modules, power control modules, and sunroof modules, for example. Parasitic emissions from these electronic devices near the routing path of the external antenna's RF cable can reduce the communication range of the asymmetric RKE system. In fact, electromagnetic compatibility ("EMC") measurements show that such interference can exceed the noise floor level of the RKE system by more than 20 dB.

In one example, a nominal communication range for asymmetrical RKE systems is approximately 100 m in the absence of parasitic emissions. Experimental measurements show that the noise received by the RF cable can exceed the noise floor of the RKE by 20 dB. Such noise level reduces the communication range of the RKE systems to 20 m or less. Generally, the effect of parasitic components on a cable can be minimized by using a special passive electronic device, such as a balun, for balancing impedances, between the antenna and RF circuit. Nevertheless, such a printed-on-circuit-board balun has a linear size equal to a quarter of the wavelength, and therefore is generally too large for automotive applications operating at 315 MHz. Therefore, automotive designers are forced to use antennas without a balun.

SUMMARY

The above-described problems are solved and a technical advance achieved by the symmetrical printed meander dipole antenna disclosed in this application. The symmetrical printed meander dipole antenna may be used for RKE automotive applications in the 315 MHz frequency band, for example. More specifically, the present symmetrical printed meander dipole antenna may be a symmetrical printed meander dipole antenna with reduced linear size for use in 315 MHz automotive applications. The symmetrical printed meander dipole antenna may be used as a substitute for the asymmetrical antennas when interference becomes a problem for 315 MHz automotive applications.

In one embodiment, the symmetrical printed meander dipole antenna includes a dielectric board including a ground plane; a first antenna trace line disposed on a first portion of the dielectric board and in electrical contact with the dielectric board, the first antenna trace line including a plurality of first vertical meandered traces; a second antenna trace line disposed on a second portion of the dielectric board and in electrical contact with the dielectric board, the second antenna trace line including a plurality of second vertical meandered traces, wherein the first and second plurality of vertical meandered traces are symmetrical to each other; and an inductor in contact with the first and second antenna trace lines for tuning the impedance of the symmetrical printed meander dipole antenna.

In one aspect, the first and second plurality of vertical meandered traces are symmetrical to each. In another aspect, the symmetrical printed meander dipole antenna further includes a first output in contact with the first antenna trace line and a second output in contact with the second antenna trace line for outputting electrical signals to a connector. Additionally, the width of the plurality of first vertical meandered traces and plurality of second vertical meandered traces is from about 17 mm to about 33 mm. In yet another aspect, the length of the plurality of first vertical meandered traces and plurality of second vertical meandered traces is from about 70 mm to about 120 mm. Preferably, the dielectric board is a FR-4 dielectric substrate.

In another embodiment, the symmetrical printed meander dipole antenna includes a dielectric board including a ground plane; a first antenna trace line disposed on a first portion of the dielectric board and in electrical contact with the dielectric board, the first antenna trace line including a plurality of first vertical meandered traces; a second antenna trace line disposed on a second portion of the dielectric board and in electrical contact with the dielectric board, the second antenna trace line including a plurality second vertical meandered traces, wherein the first and second plurality of vertical meandered traces are symmetrical to each other; an inductor in contact with the first and second antenna trace lines; and a first plurality of asymmetrical edge meandered antenna trace lines in contact with the first antenna trace line and a second plurality of asymmetrical edge meandered antenna trace lines in contact with the second antenna trace line, the inductor and first and second edge meandered antenna trace lines for tuning the impedance of the symmetrical printed meander dipole antenna.

In one aspect, the first and second plurality of vertical meandered traces are symmetrical to each. In another aspect, the symmetrical printed meander dipole antenna further includes a first output in contact with the first antenna trace line and a second output in contact with the second antenna trace line for outputting electrical signals to a connector. Preferably, the width of the plurality of first vertical meandered traces and plurality of second vertical meandered traces is from about 17 mm to about 33 mm. More preferably, the length of the plurality of first vertical meandered traces and plurality of second vertical meandered traces is from about 70 mm to about 120 mm. Additionally, the width of the plurality of first vertical meandered traces and first plurality of asymmetrical edge meandered antenna trace lines is approximately 54 mm. In another aspect, each of the plurality of first vertical meandered traces and the plurality of first vertical meandered traces is from about 16 to about 20 meandered traces. In yet another aspect, the dielectric board is a FR-4 dielectric substrate.

In yet another embodiment, the symmetrical printed meander dipole antenna includes a dielectric board including a ground plane; a first antenna trace line disposed on a first portion of the dielectric board and in electrical contact with the dielectric board, the first antenna trace line including a plurality of first vertical meandered traces; a second antenna trace line disposed on a second portion of the dielectric board and in electrical contact with the dielectric board, the second antenna trace line including a plurality second vertical meandered traces, wherein the first and second plurality of vertical meandered traces are symmetrical to each other; an inductor in contact with the first and second antenna trace lines; a first plurality of asymmetrical edge meandered antenna trace lines in contact with the first antenna trace line and a second plurality of asymmetrical edge meandered antenna trace lines in contact with the second antenna trace line, the inductor and first and second edge meandered antenna trace lines for tuning the impedance of the symmetrical printed meander dipole antenna; and a resistor in electrical contact with the first antenna trace line and the second antenna trace line for providing frequency bandwidth.

In one aspect, the first and second plurality of vertical meandered traces are symmetrical to each. In another aspect, the symmetrical printed meander dipole antenna further includes a first output in contact with the first antenna trace line and a second output in contact with the second antenna trace line for outputting electrical signals to a connector. In yet another aspect, the width of the plurality of first vertical meandered traces and plurality of second vertical meandered traces is from about 17 mm to about 33 mm. Preferably, the length of the plurality of first vertical meandered traces and plurality of second vertical meandered traces is from about 70 mm to about 120 mm. More preferably, the width of the plurality of first vertical meandered traces and first plurality of asymmetrical edge meandered antenna trace lines is approximately 54 mm. Also, each of the plurality of first vertical meandered traces and the plurality of first vertical meandered traces is from about 16 to about 20 meandered traces. In one aspect, the dielectric board is a FR-4 dielectric substrate.

Preferably, the resistor has a value of from about 0 to about 100 Ohms. More preferably, the resistor has a value of from about 35 to about 75 Ohms. Even more preferably, the resistor has a value of approximately 64 Ohms.

In still yet another embodiment, the present invention includes a vehicle having a symmetrical printed meander dipole antenna including a vehicle body; a symmetrical printed meander dipole antenna disposed on the vehicle body; a control module disposed on the vehicle body; and a connector connecting the symmetrical printed meander dipole antenna with the control module. In one aspect, the symmetrical printed meander dipole antenna includes a dielectric board including a ground plane; a first antenna trace line disposed on a first portion of the dielectric board and in electrical contact with the dielectric board, the first antenna trace line including a plurality of first vertical meandered traces; a second antenna trace line disposed on a second portion of the dielectric board and in electrical contact with the dielectric board, the second antenna trace line including a plurality second vertical meandered traces, wherein the first and second plurality of vertical meandered traces are symmetrical to each other; an inductor in contact with the first and second antenna trace lines; a first plurality of asymmetrical edge meandered antenna trace lines in contact with the first antenna trace line and a second plurality of asymmetrical edge meandered antenna trace lines in contact with the second antenna trace line, the inductor and first and second edge meandered antenna trace lines for tuning the impedance of the symmetrical printed meander dipole antenna; and a resistor in electrical contact with the first antenna trace line and the second antenna trace line for providing frequency bandwidth.

In another aspect, the first and second plurality of vertical meandered traces are symmetrical to each. In yet another aspect, the vehicle further includes a first output in contact with the first antenna trace line and a second output in contact with the second antenna trace line for outputting electrical signals to a connector. Additionally, the width of the plurality of first vertical meandered traces and plurality of second vertical meandered traces is from about 17 mm to about 33 mm. Also, the length of the plurality of first vertical meandered traces and plurality of second vertical meandered traces is from about 70 mm to about 120 mm. Preferably, the width of the plurality of first vertical meandered traces and first plurality of asymmetrical edge meandered antenna trace lines is approximately 54 mm. The plurality of first vertical meandered traces and the plurality of first vertical meandered traces is from about 16 to about 20 meandered traces. In another aspect, the dielectric board is a FR-4 dielectric substrate. In yet another aspect, the resistor has a value of from about 0 to about 100 Ohms. In still yet another aspect, the resistor has a value of from about 35 to about 75 Ohms. Preferably, the resistor has a value of approximately 64 Ohms.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE DRAWINGS

Figure 2:
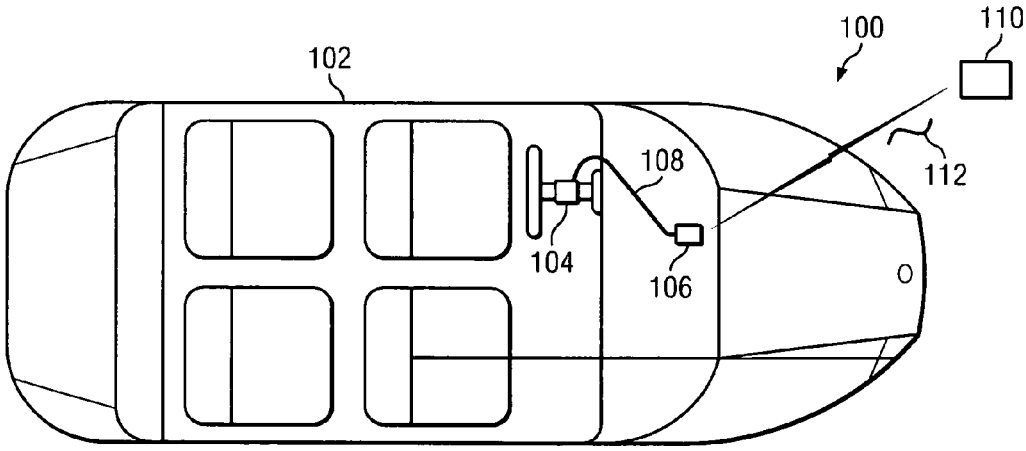
FIG. 2 is an illustration of an exemplary vehicle including an exemplary symmetrical printed meander dipole antenna and RKE control module according to an embodiment of the present invention.
Figure 3:
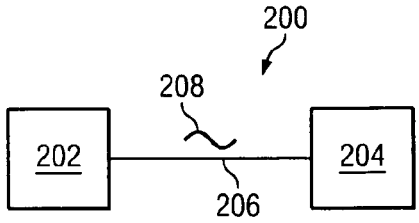
FIG. 3 is an illustration of an exemplary symmetrical printed meander dipole antenna configured to receive RF signals according to an embodiment of the present invention.

FIG. 2 is an illustration of an exemplary vehicle 100 having a vehicle body 102 including an exemplary configuration of a symmetrical printed meander dipole antenna 106 and control module 104 connected together by a connector 108. Symmetrical printed meander dipole antenna 106, connector 108, and control module 104 are disposed on and/or supported on vehicle body 102 such as to provide communication with a source of RF signals 112, such as an antenna or transponder 110. FIG. 3 is an illustration of an exemplary system 200 configured to receive RF signals. System 200 may include a symmetrical printed meander dipole antenna 202 connected to a control module 204, such as an RKE control module, via a connector 206. Symmetrical printed meander dipole antenna 202, control module 204, and connector 206 may be disposed on and/or located on vehicle body 102, for example. RF signals 208 are communicated between symmetrical printed meander dipole antenna 202 and control module 204 via connector 206.

In operation, symmetrical printed meander dipole antenna 202 may be configured to receive RF signals 208, such as RKE signals having a wavelength of 315 MHz, for example, which are communicated to control module 204 via connector 206. In one aspect, the RF signals 208 may be digital data that is communicated to control module 204 to cause control module 204 to lock and unlock doors of a vehicle, for example.

Figure 4:
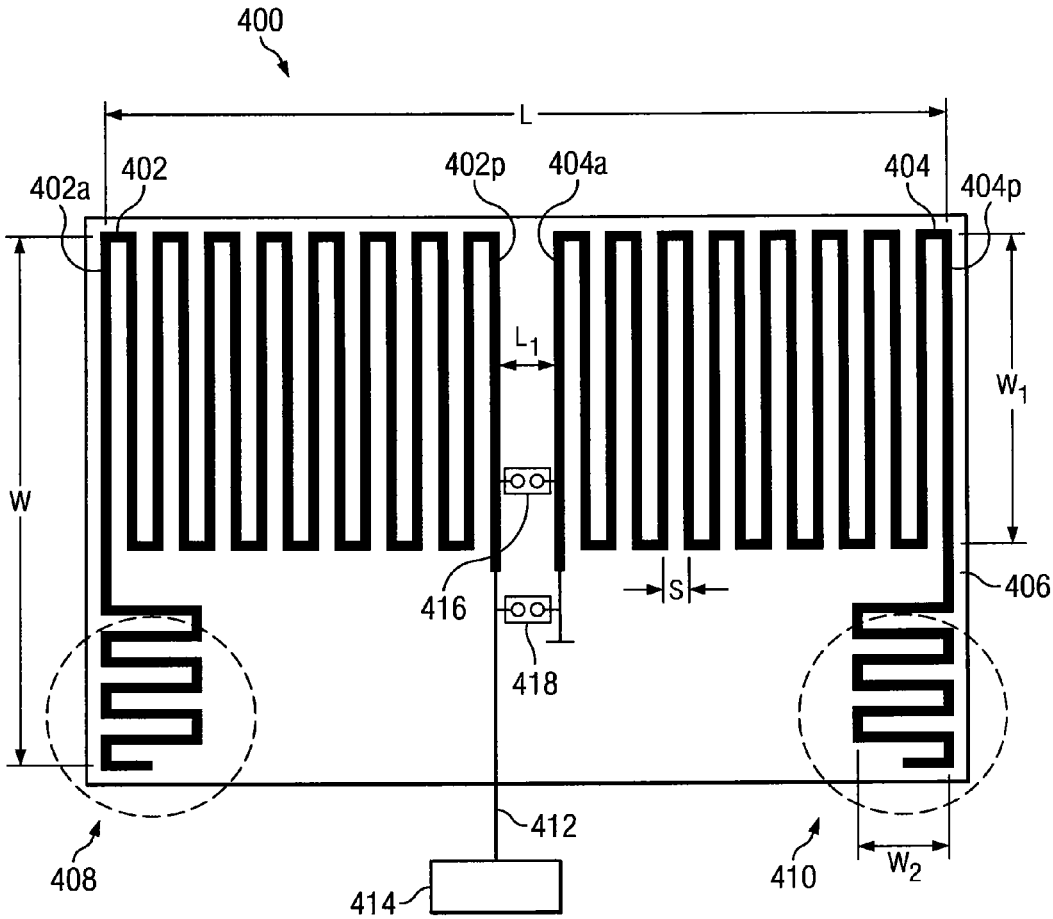
FIG. 4 is an illustration of a plan view of a symmetrical printed meander dipole antenna according to an embodiment of the present invention.

Referring to FIGS. 4-7, illustrations of plan views of embodiments of symmetrical printed meander dipole antennas 400, 500, 600, and 700 having different widths and lengths are shown. In FIG. 4, a symmetrical printed meander dipole antenna 400 is shown with a first antenna trace line 402 and a second antenna trace line 404 that are printed on PCB 406. First antenna trace line 402 and second antenna trace line 404 may be connected to a control module 414 via a connector 412. First antenna trace line 402 and second antenna trace line 404 are printed on one side of PCB 406. Symmetrical printed meander dipole antenna 400 may further include an inductor 416 disposed between first antenna trace line 402 and second antenna trace line 404 and additional cutting of the edge antenna trace lines bends 408 and 410 for additional impedance tuning of symmetrical printed meander dipole antenna 400. In one embodiment, symmetrical printed meander dipole antenna 400 may further include a resistor 418 for providing additional frequency bandwidth.

In one embodiment, first antenna trace line 402 and second antenna trace line 404 may each include 16 vertical traces, 402*a*-402*p* and 404*a*-404*p*, respectively. Vertical traces 402*a*-402*p* and 404*a*-404*p* may have a length L equal to approximately 70 mm, for example. Vertical traces 402*a*-402*p* and 404*a*-404*p* may have a width W1 equal to approximately 33 mm, for example. Additionally, the distance L1 between first antenna trace line 402 and second antenna trace line 404 may be approximately 5 mm. The width W of the first antenna trace line 402 and additional trace line bends 408 is approximately 54 mm, as is the width W of the second antenna trace line 404 and additional trace line bends 410, in one example. Preferably, the width W2 of the additional trace line bends 408 and 410 is approximately 6 mm. Further, in one aspect, the distance S between each of the vertical traces 402*a*-402*p* and 404*a*-404*p* is approximately 1 mm. In one aspect, vertical traces 402*a*-402*p* and 404*a*-404*p* may be made from a conducting material, such as copper.

Figure 5:
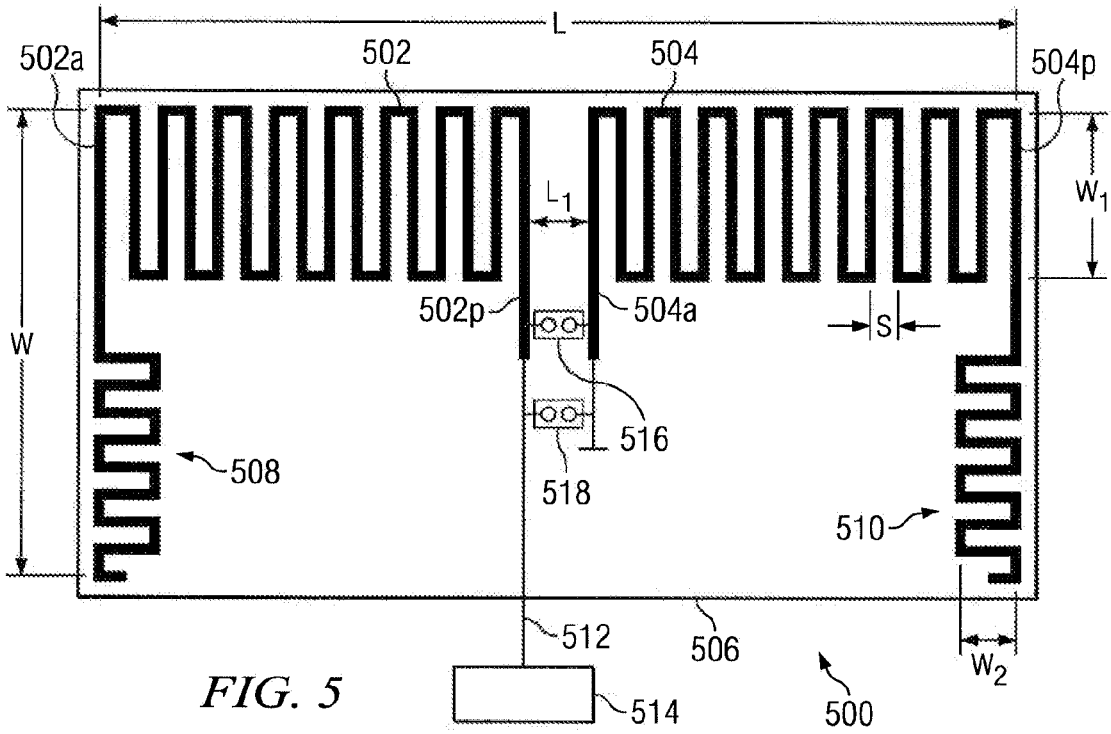
FIG. 5 is an illustration of a plan view of a symmetrical printed meander dipole antenna according to another embodiment of the present invention.

Referring to FIG. 5, a symmetrical printed meander dipole antenna 500 is shown with a first antenna trace line 502 and a second antenna trace line 504 that are printed on PCB 506. First antenna trace line 502 and second antenna trace line 504 may be connected to a control module 514 via a connector 512. First antenna trace line 502 and second antenna trace line 504 are printed on one side of PCB 506. Symmetrical printed meander dipole antenna 500 may further include an inductor 516 disposed between first antenna trace line 502 and second antenna trace line 504 and additional cutting of the edge antenna trace lines bends 508 and 510 for additional impedance tuning of symmetrical printed meander dipole antenna 500. In one embodiment, symmetrical printed meander dipole antenna 500 may further include a resistor 518 for providing additional frequency bandwidth.

In one embodiment, first antenna trace line 502 and second antenna trace line 504 may each include 16 vertical traces, 502*a*-502*p* and 504*a*-504*p*, respectively. Vertical traces 502*a*-502*p* and 504*a*-504*p* may have a length L equal to approximately 100 mm, for example. Vertical traces 502*a*-502*p* and 504*a*-504*p* may have a width W1 equal to approximately 17 mm, for example. Additionally, the distance L1 between first antenna trace line 502 and second antenna trace line 504 may be approximately 6 mm. The width W of the first antenna trace line 502 and additional trace line bends 508 is approximately 54 mm, as is the width W of the second antenna trace line 504 and additional trace line bends 510, in one example. Preferably, the width W2 of the additional trace line bends 508 and 510 is approximately 6 mm. Further, in one aspect, the distance S between each of the vertical traces 502*a*-502*p* and 504*a*-504*p* is approximately 3 mm.

Figure 6:
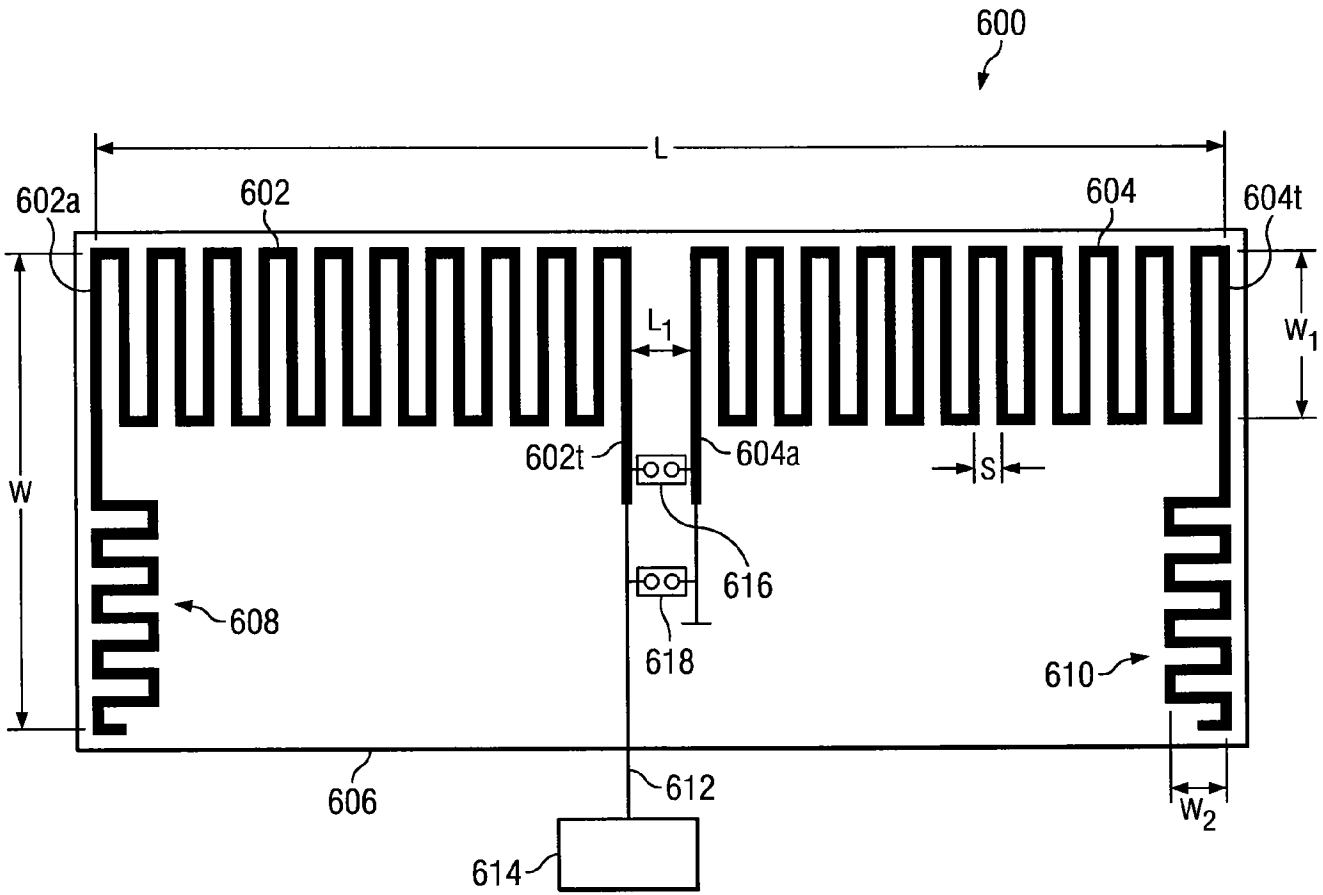
FIG. 6 is an illustration of a plan view of a symmetrical printed meander dipole antenna according to another embodiment of the present invention.

Referring to FIG. 6, symmetrical printed meander dipole antenna 600 is shown with a first antenna trace line 602 and a second antenna trace line 604 that are printed on PCB 606. First antenna trace line 602 and second antenna trace line 604 may be connected to a control module 614 via a connector 612. First antenna trace line 602 and second antenna trace line 604 are printed on one side of PCB 606. Symmetrical printed meander dipole antenna 600 may further include an inductor 616 disposed between first antenna trace line 602 and second antenna trace line 604 and additional cutting of the edge antenna trace lines bends 608 and 610 for additional impedance tuning of symmetrical printed meander dipole antenna 600. In one embodiment, symmetrical printed meander dipole antenna 600 may further include a resistor 618 for providing additional frequency bandwidth.

In one embodiment, first antenna trace line 602 and second antenna trace line 604 may each include 20 vertical traces, 602*a*-602*t* and 604*a*-604*t*, respectively. Vertical traces 602*a*-602*t* and 604*a*-604*t* may have a length L equal to approximately 120 mm, for example. Vertical traces 602*a*-602*t* and 604*a*-604*t* may have a width W1 equal to approximately 17 mm, for example. Additionally, the distance L1 between first antenna trace line 602 and second antenna trace line 604 may be approximately 6 mm. The width W of the first antenna trace line 602 and additional trace line bends 608 is approximately 54 mm, as is the width W of the second antenna trace line 604 and additional trace line bends 610, in one example. Preferably, the width W2 of the additional trace line bends 608 and 610 is approximately 6 mm. Further, in one aspect, the distance S between each of the vertical traces 602*a*-602*t* and 604*a*-604*t* is approximately 3 mm.

Figure 7:
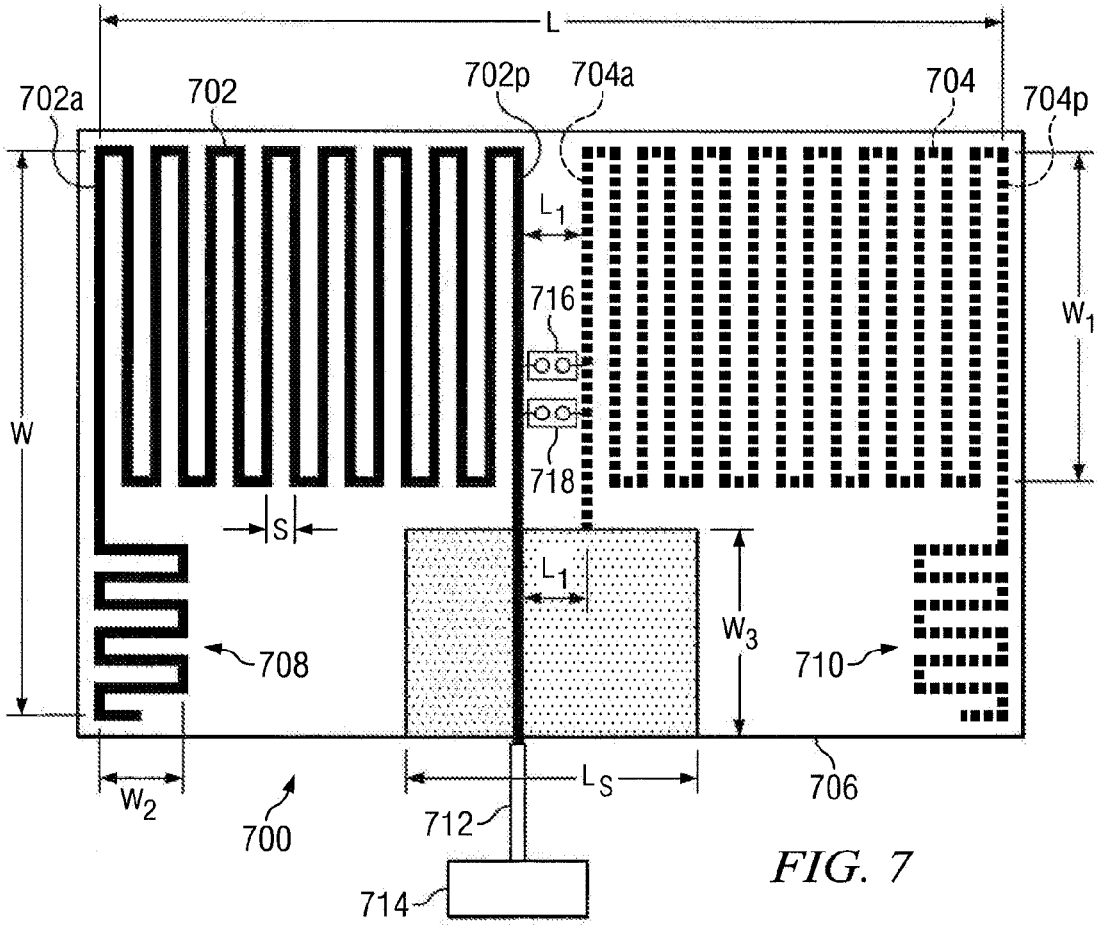
FIG. 7 is an illustration of a plan view of a symmetrical printed meander dipole antenna according to another embodiment of the present invention.

Referring to FIG. 7, symmetrical printed meander dipole antenna 700 is shown with a first antenna trace line 702 and a second antenna trace line 704 that are printed on PCB 706. First antenna trace line 702 and second antenna trace line 704 may be connected to a control module 714 via a connector 712. First antenna trace line 702 is printed on the top of PCB 706 and second antenna trace line 704 is printed on the back of PCB 706. Symmetrical printed meander dipole antenna 700 may further include an inductor 716 disposed between first antenna trace line 702 and second antenna trace line 704 and additional cutting of the edge antenna trace lines bends 708 and 710 for additional impedance tuning of symmetrical printed meander dipole antenna 700. In one embodiment, symmetrical printed meander dipole antenna 700 may further include a resistor 718 for providing additional frequency bandwidth.

In one embodiment, first antenna trace line 702 and second antenna trace line 704 may each include 16 vertical traces, 702*a*-702*p* and 704*a*-704*p*, respectively. Vertical traces 702*a*-702*p* and 704*a*-704*p* may have a length L equal to approximately 70 mm, for example. Vertical traces 702*a*-702*p* and 704*a*-704*p* may have a width W1 equal to approximately 33 mm, for example. Additionally, the distance L1 between first antenna trace line 702 and second antenna trace line 704 may be approximately 5 mm. The width W of the first antenna trace line 702 and additional trace line bends 708 is approximately 54 mm, as is the width W of the second antenna trace line 704 and additional trace line bends 710, in one example. Preferably, the width W2 of the additional trace line bends 708 and 710 is approximately 6 mm. Further, in one aspect, the distance S between each of the vertical traces 702*a*-702*p* and 704*a*-704*p* is approximately 1 mm. Preferably, the distance LS is 24 mm and the width WS is 12 mm, for example.

In another embodiment, first antenna trace line 702 and second antenna trace line 704 may each include 16 vertical traces, 702*a*-702*p* and 704*a*-704*p*, respectively. Vertical traces 702*a*-702*p* and 704*a*-704*p* may have a length L equal to approximately 70 mm, for example. Vertical traces 702*a*-702*p* and 704*a*-704*p* may have a width W1 equal to approximately 10 mm to 35 mm, for example. Additionally, the distance L1 between first antenna trace line 702 and second antenna trace line 704 may be approximately 4 mm. The width W of the first antenna trace line 702 and additional trace line bends 708 is approximately 48 mm, as is the width W of the second antenna trace line 404 and additional trace line bends 710, in one example. Preferably, the width W2 of the additional trace line bends 708 and 710 is approximately 6 mm. Further, in one aspect, the distance S between each of the vertical traces 702*a*-702*p* and 704*a*-704*p* is approximately 1 mm. Preferably, the distance LS is 25 mm and the width WS is 11 mm, for example. In one aspect, vertical traces 702*a*-702*p* and 704*a*-704*p* may be made from a conducting material, such as copper. Symmetrical printed meander dipole antenna 700 may further include an inductor having a value of approximately equal to 15 nH and a resistor value equal to approximately 64 Ohms. Additionally, the main electrical parameters for the passive antenna part may include a standing wave ratio ("SWR") (315 MHz) that is equal to 1.2. A gain may be equal to approximately −5 dBi to −6 dBi. Also, the cable location effect may be +/−1 dB. In one embodiment, the antenna amplifier gain may be about 15 dB and a noise figure may be about 1 dB with residual noise of the active antenna in the anechoic chamber is less than −99 dBm.

In one embodiment, symmetrical printed meander dipole antennas 600 and 700 further include a ground spot that may be located on the bottom side of PCB 606 and 706, respectively, that may be used as a ground for the amplifier circuit when using symmetrical printed meander dipole antennas 600 and 700 in an active receiving embodiment. In one aspect, the lengths and number of bends of first antenna trace line 402, second antenna trace line 404, first antenna trace line 502, second antenna trace line 504, first antenna trace line 602, second antenna trace line 604, first antenna trace line 702, and second antenna trace line 704 may be chosen using electromagnetic software, such as IE3D, to provide a desirable resistance, such as 50 Ohms input impedance for a particular application. Additionally, impedance tuning may further be optimized by using inductors 416, 516, 616, and 716 in addition to the additional cutting of the trace lines as described herein. In one embodiment control modules 414, 514, 614, and 714 are RKE control modules.

PCBs 406, 506, 606, and 706 may be a width that is desirable for a particular application. The width of the printed antenna trace lines may be any desired width for a particular application. In one embodiment, the width of the printed antenna trace lines 402, 404, 502, 504, 602, 604, 702, and 704 are approximately 1 mm. As can be seen in FIGS. 4-6, the symmetrical dipole geometries have an increasing length among FIGS. 4-6, but all lengths are preferably less than 1/10 of the wavelength of the transmitted or received radio frequency RF signal. PCBs 406, 506, 606, and 706 may further include a ground plane (not shown) with a dielectric board (not shown) disposed thereon. In one embodiment, the dielectric board of PCBs 406, 506, 606, and 706 may be composed of FR-4 material and have a thickness of approximately 1.6 mm and a relative permittivity of 4.4. It should be understood in the art that the configuration of the outputs of PCBs 406, 506, 606, and 706 may have alternative configurations and the dielectric board may be composed of another material and have a different thickness and provide an operable antenna solution. In one embodiment, ground pads are used as the second "arm" on each of these symmetrical printed meander dipole antennas 400, 500, 600, and 700; the pads serve concomitantly as low-noise amplifier grounds. The low-noise amplifier located at the antenna trace line side may increase the sensitivity of the receiver, for example.

As further understood in the art, physical parameters of an antenna may be used for adjusting bandwidth to receive signals, such as RF signals, over a frequency band for tuning impedance of the antenna over the frequency band, and for adjusting gain over the bandwidth. For example, connectors 412, 512, 612, and 712 are used to conduct RF signals to RF circuits, such as those associated with control modules 414, 514, 614, and 714. If the output of the antenna portion has a certain impedance that includes only resistive component (reactive component value is equal to), then if the RF circuit has the same input impedance, a voltage standing wave ratio ("VSWR") will have a value of 1.0 and the RF signal will be completely input into the RF circuit (i.e., no part of the RF signal will reflect back from the RF circuit). If the output impedance of symmetrical printed meander dipole antennas 400, 500, 600, and 700 and the input impedance of the RF circuit do not match, the VSWR increases to a multiple of 1.0, where the higher the ratio, the higher the VSWR and the lower the input of the RF input impedance of the RF circuit. These fundamental RF principles drive the configuration of symmetrical printed meander dipole antennas 400, 500, 600, and 700. Because slight differences in the configuration of the symmetrical printed meander dipole antennas 400, 500, 600, and 700 can have large effects in tuning symmetrical printed meander dipole antennas 400, 500, 600, and 700 over the frequency range of a desired application(s), many configurations of the basic structure of symmetrical printed meander dipole antennas 300, 400, 500, 600, and 700 may be used to provide RF output to control modules 414, 514, 614, and 714 at a certain resistance (e.g., 50 Ohms) to match a resistance of an RF circuit (e.g., 50 Ohms). Of course, in practice, it is difficult to have a resistance of an antenna over a frequency range at approximately 50 Ohms as, typically, the resistance, even if well tuned, may be 50+/−10 Ohms, for example, that varies over the frequency range. In addition, the resistance has a mathematical imaginary component that also varies over the frequency of symmetrical printed meander dipole antennas 300, 400, 500, 600, and 700. These fundamental RF principles can be seen on a Smith chart (see, for example, FIGS. 16, 19, and 22). As the impedance of the symmetrical printed meander dipole antennas 300, 400, 500, 600, and 700 and RF circuit vary over the frequency bands, the matching of the impedances vary and, therefore, VSWR over the RF bands varies. As the VSWR varies, the gain of the system varies because the closer to unity of the VSWR, the higher the gain of the RF signals being received by the RF circuit.

The radiation efficiency i) for symmetrical printed meander dipole antennas 300, 400, 500, 600, and 700 are described below in Table 1. The efficiency and the directionality were each calculated with IE3D electromagnetic software both with and without an RF cable. The simulation results are for these symmetrical printed meander dipole antennas 300, 400, 500, 600, and 700 with different linear antenna sizes are presented graphically in Table 1, below.

TABLE 1

Simulation Results of the Radiation Efficiency η for Different Linear Antenna Sizes

| | | Efficiency η | |
|---|---|---|---|
| Type | Length (mm) | Without Cable | With 1 m Cable |
| Printed Meandered Dipole (FIG. 4) | 70 | 0.23 | 0.28 |
| Printed Meandered Dipole (FIG. 5) | 100 | 0.42 | 0.45 |
| Printed Meandered Dipole (FIG. 6) | 120 | 0.52 | 0.54 |
| Printed Meandered Dipole (FIG. 7) | 70 + ground spot | 0.21 | 0.33 |
| Printed Asymmetrical Meander Line (FIG. 1) | 70 | 0.12 | 0.45 |
| Wire Half-Wave Dipole | 475 | 0.98 | 0.98 |

The frequency of the above results in Table 1 is 315 MHz. As can be seen in Table 1, asymmetrical meander antenna 50 without a RF cable had the lowest antenna efficiency value: 0.12 (−9.2 dB). In comparison, symmetrical printed meander dipole antenna 400 was 1.9 times more efficient. Table 1 also shows that asymmetrical meander antenna 50 with a RF cable had the same efficiency as symmetrical printed meander dipole antenna 500 without an RF cable. This indicates that the RF cable is a significant enhancement to asymmetrical meander antenna 50. Such an antenna could therefore be effective in vehicle applications where electronic components near the RF cable do not radiate interference at the 315 MHz frequency band. It is significant to contrast these findings with those pertaining to symmetrical printed meander dipole antennas 400, 500, 600, and 700. In the latter instance, there is scarcely any difference between the efficiency of the antenna either with or without the RF cable. This means that the RF cable effect for symmetrical printed meander dipole antennas 400, 500, 600, and 700 is minimal. Additionally, the ground spot shown in symmetrical printed meander dipole antenna 700 does not appear to significantly influence the efficiency of the dipole.

Referring to FIGS. 8-11, polar plots 800-1100 show simulated and measured results for symmetrical printed meander dipole antenna 400 and asymmetrical meander antenna 50. Polar plots 800-1100 show calculated horizontally polarized directionalities with two different lengths of RF cable, LC. Antenna orientation with regard to the directionality angles is seen where the performances of asymmetrical meander antenna 50 are similar to the performance of symmetrical printed meander dipole antenna 400 with total length values that cause a multi-lobe structure (i.e., more than one wavelength).

Polar plot 800 shows the simulated results for symmetrical printed meander dipole antenna 400 with a RF cable length of 65 cm and polar plot 900 shows the simulated results for symmetrical printed meander dipole antenna 400 with a RF cable length of 160 cm. Polar plot 800 shows a far field directivity plot 802 versus angle resulting from a simulation of symmetrical printed meander dipole antenna 400 and polar plot 900 shows a far field directivity plot 902 resulting from a simulation of symmetrical printed meander dipole antenna 400.

Polar plot 1000 shows the simulated results for asymmetrical meander antenna 50 with a RF cable length of 65 cm and polar plot 1100 shows the simulated results for asymmetrical meander antenna 50 with a RF cable length of 160 cm. Polar plot 100 shows a far field directivity plot 1002 versus angle resulting from a simulation of asymmetrical meander antenna 50 and polar plot 1100 shows a far field directivity plot 1102 resulting from a simulation of asymmetrical meander antenna 50.

Figure 1:
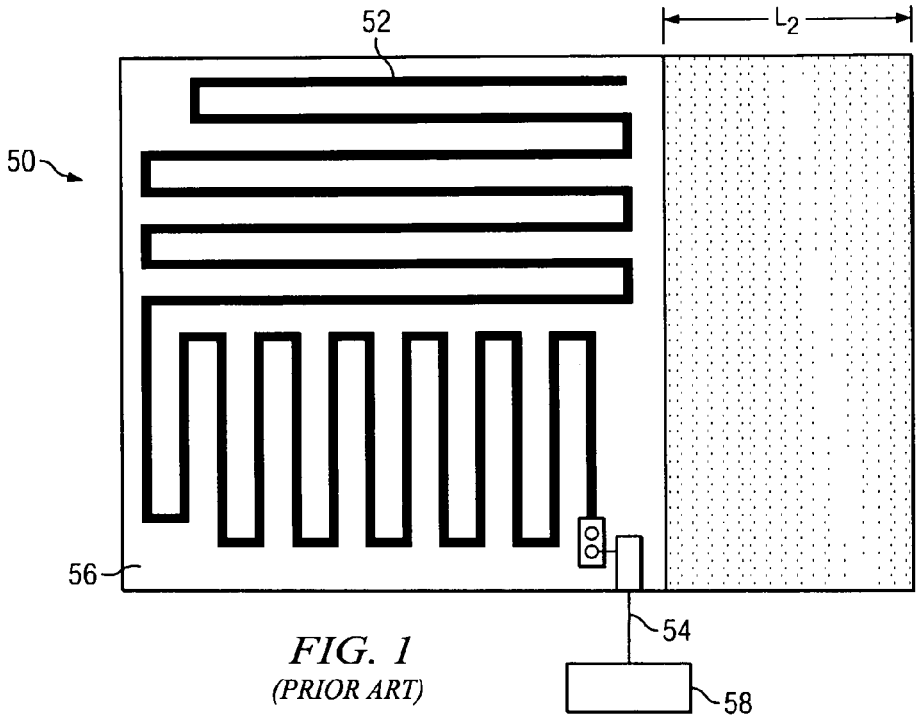
FIG. 1 (PRIOR ART)
FIG. 1 is an illustration of a plan view of a conventional asymmetrical meander antenna.
Figure 12:
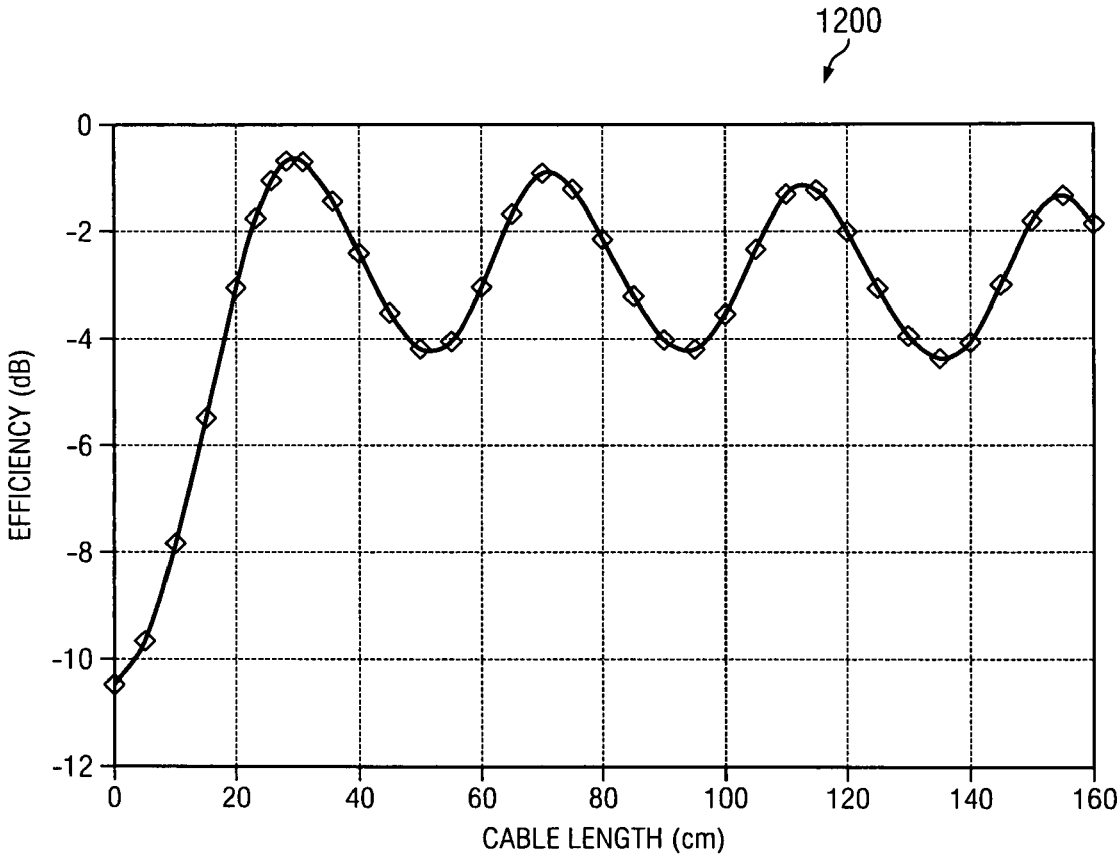
FIG. 12 illustrates a graph showing the calculated ratio between efficiency and the cable length for an asymmetrical meander antenna.

Referring to FIG. 12, a graph 1200 shows the calculated ratio between the efficiency $\eta$ and the cable length (expressed in cm) for asymmetrical meander antenna 50 shown in FIG. 1. Efficiency expressed in dB format was normalized to the half-wave dipole efficiency. As can be seen, asymmetrical meander antenna 50 with a RF cable length of approximately 25 cm has an efficiency almost equivalent to that of the half wave dipole. In such a configuration, asymmetrical meander antenna 50 together with its cable shows more gain than the symmetrical printed meander dipole antenna 400, for example. This efficiency is also very similar to that of a coaxial antenna with an inner conductor length value equal to one quarter of the wavelength. Here, instead of the inner conductor of the coaxial antenna, a meander line with a linear size much less than one-quarter wavelength is used, but with a total trace length of more than a quarter wavelength.

Additionally, a mean square error parameter $\in$, averaged over 360°, which numerically estimates the similarity between two power directionality curves: the first when $F(\theta)$ corresponds to the antenna without a cable, and the second when $F_1(\theta)$ corresponds to the antenna with an RF cable. The results are presented graphically in Table 2, below.

TABLE 2

Calculated Results

| Type | Length (mm) | Mean Square Error $\epsilon$ |
|---|---|---|
| Printed Meandered Dipole (FIG. 4) | 70 | 0.3 |
| Printed Meandered Dipole (FIG. 5) | 100 | 0.16 |
| Printed Meandered Dipole (FIG. 6) | 120 | 0.15 |
| Printed Meandered Dipole (FIG. 7) | 70 + ground spot | 0.74 |
| Printed Asymmetrical Meander Line (FIG. 1) | 70 | 0.81 |

As can be seen, asymmetrical meander antenna 50 of FIG. 1 has a maximum error value a, which means that this antenna benefits from the largest increase in gain due to the added effect of the RF cable, but can suffer from interference effects due to the parasitic interference sources in a vehicle located close to the RF cable route. Symmetrical printed meander dipole antenna 600 has the smallest error e, which means that this antenna has a minimal benefit from the addition of the cable, but also minimal possible interference effects. From these results, it is possible to conclude that, if a vehicle does not have electronic components that radiate parasitic emissions at 315 MHz, it is preferable to use an asymmetrical design, such as asymmetrical meander antenna 50, with careful RF cable routing that can increase the communication range. Nevertheless, if electronic components radiate parasitic emissions near the cable path route, a symmetrical dipole antenna, such as symmetrical printed meander dipole antennas 400-700 is a better antenna for RKE automotive applications.

These results were confirmed by actual measurement as well. A passive meander line dipole antenna printed on an FR-4 dielectric substrate was placed horizontally (the substrate board plane was parallel to the floor plane) on a turntable. The antenna was made to operate in the transmitting mode. A horizontally polarized receiving Yagi antenna operating in a frequency range from symmetrical printed meander dipole antenna 300 to 1000 MHz was located in the far zone of the antenna assembly (this represented a passive antenna under test with a RF cable). Resulting directionality measurements are presented over 360° in the horizontal plane for the horizontal polarization. A RF cable (RG 174 cable) was used for the measurements, with losses equal to 0.5 dB per meter in the 315 MHz frequency band.

Figure 13:
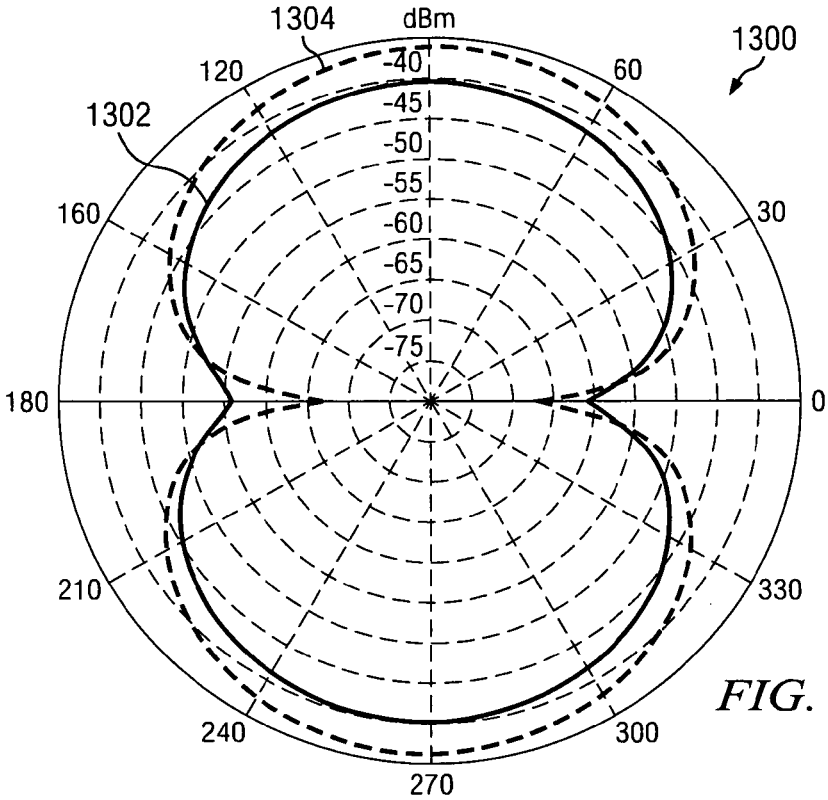
FIG. 13 illustrates a polar plot of the measured results for a symmetrical printed meander dipole antenna without RF cable according to an embodiment of the present invention.
Figure 14:
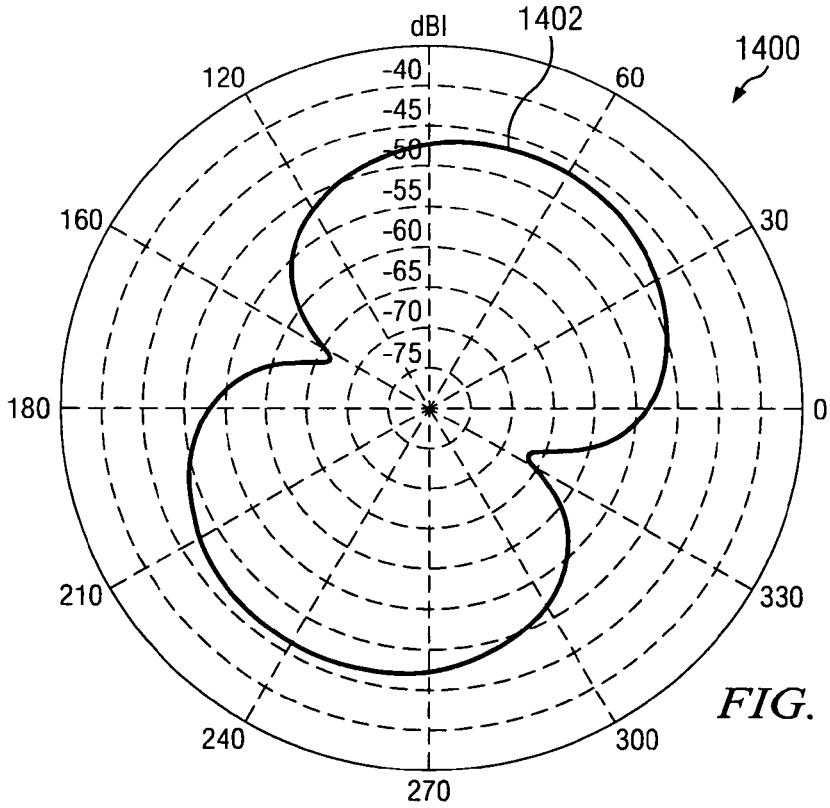
FIG. 14 illustrates a polar plot of the measured results for an asymmetrical meander dipole antenna without a RF cable.

The measurement results for symmetrical printed meander dipole antenna 400 and asymmetrical meander antenna 50 are presented in polar plots 800-1100 and FIGS. 13 and 14. FIG. 13 is a polar plot 1300 of the measured results for symmetrical printed meander dipole antenna 400 without a RF cable as shown by a far field directivity plot 1302 and a far field directivity plot for a reference antenna 1304. FIG. 14 is a polar plot of the measured results for asymmetrical meander antenna 50. All the plots in FIGS. 8-11 demonstrate the horizontal polarization directionality graphs in the azimuth plane for an antenna assembly consisting of a meander line antenna with different RF cable lengths.

Figure 8:
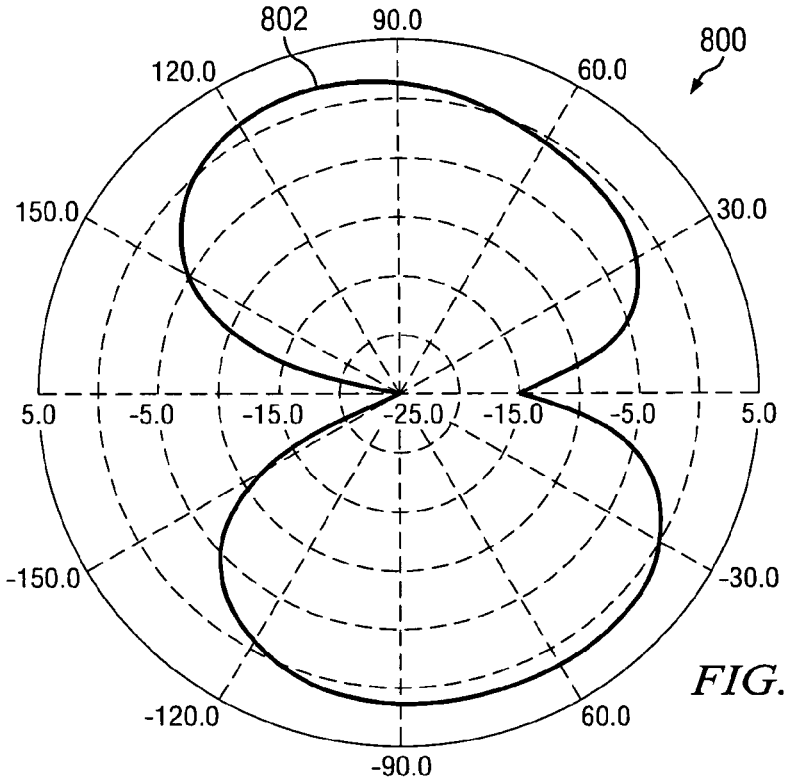
FIG. 8 illustrates a polar plot of a symmetrical printed meander dipole antenna having a RF cable length of 65 cm according to an embodiment of the present invention.
Figure 9:
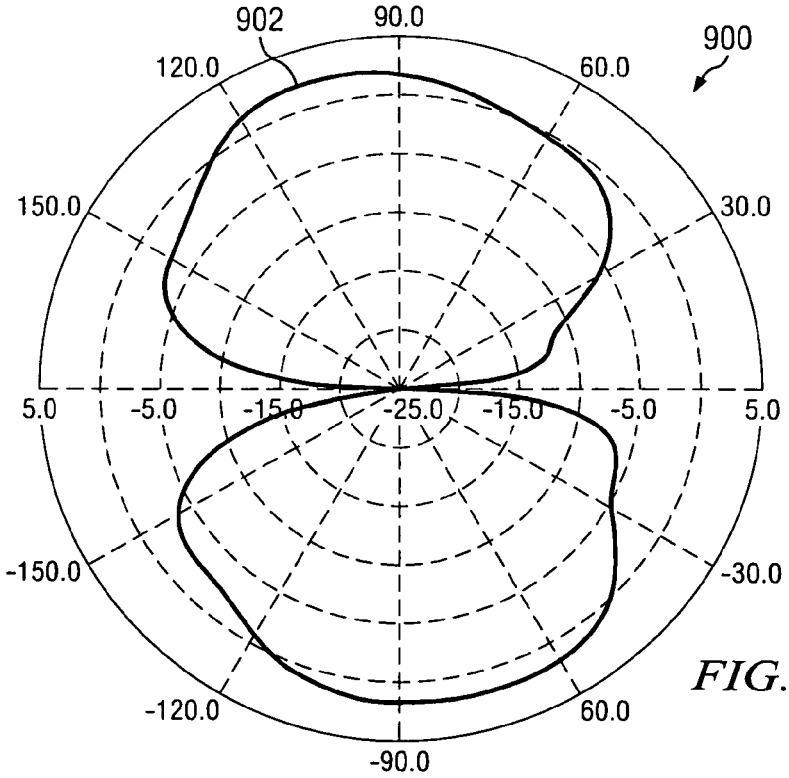
FIG. 9 illustrates a polar plot of a symmetrical printed meander dipole antenna having a RF cable length of 160 cm according to another embodiment of the present invention.
Figure 10:
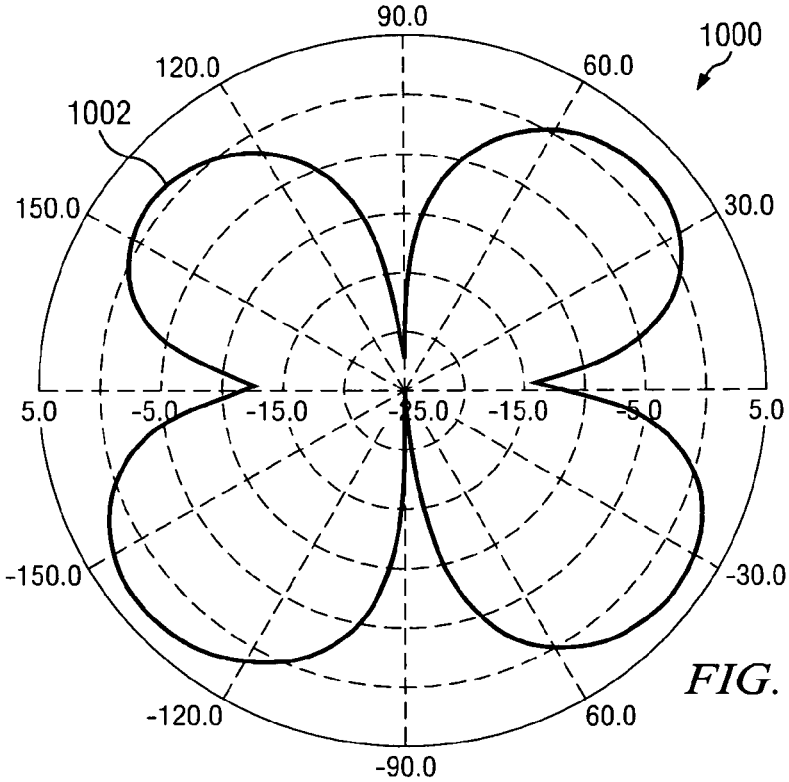
FIG. 10 illustrates a polar plot of an asymmetrical printed meander dipole antenna having a RF cable length of 65 cm.
Figure 11:
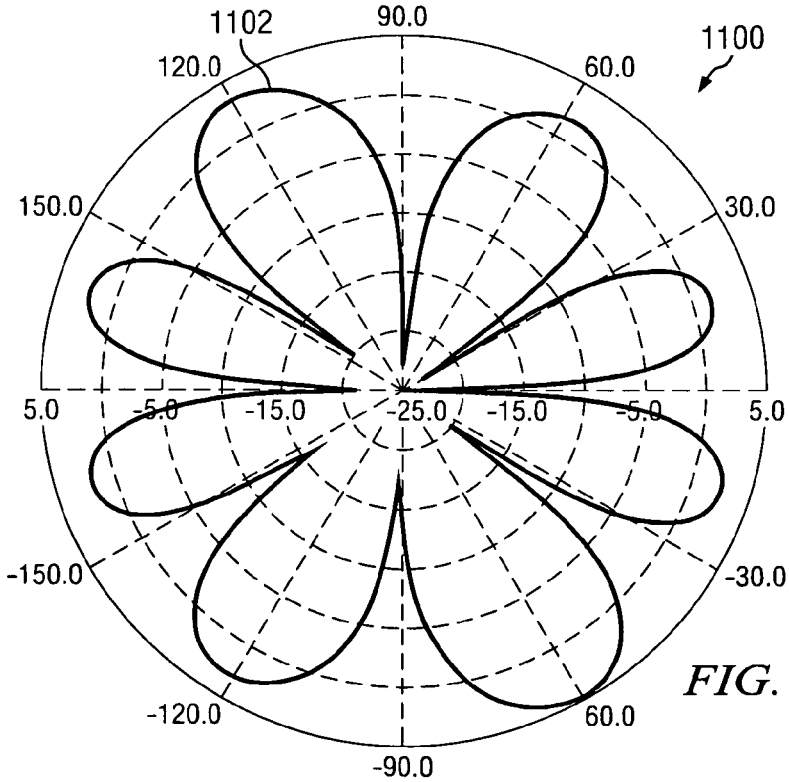
FIG. 11 illustrates a polar plot of an asymmetrical printed meander dipole antenna having a RF cable length of 160 cm.

FIG. 8 shows the directionality of a symmetrical dipole in the case where the cable length is equal to 65 cm and FIG. 9 corresponds to a cable length of 1.6 m, as discussed above. FIGS. 10 and 11 show the horizontally polarized directionality plots in the azimuth plane for an antenna assembly consisting of an asymmetrical meander line antenna with an RF cable. FIGS. 10 and 11 show more than two main lobes. Again, good agreement between the simulated and measured results are shown in that both show very strong improvements on the antenna performances because of the effects of the cable.

Referring to FIGS. 13 and 14, these plots show the antenna directionality of symmetrical printed meander dipole antenna 400 and asymmetrical meander antenna 50 without an RF cable (the dashed line indicates the reference antenna directionality). The average (over 360°) gain of the printed dipole is less than the gain of the reference antenna by a value of −4 dB. The average gain of asymmetrical meander antenna 50 is less than the gain of the reference antenna by a value of −9 dB. These measurement results confirm the findings of the numerical simulation: that the cable effect is not very significant in regards to the performance of the symmetrical antenna, such as symmetrical printed meander dipole antennas 400-700. As can be seen, the medium (L=100 mm) and large antenna (L=120 mm) sizes show the same level of agreement between simulation and measurement results.

Figure 15:
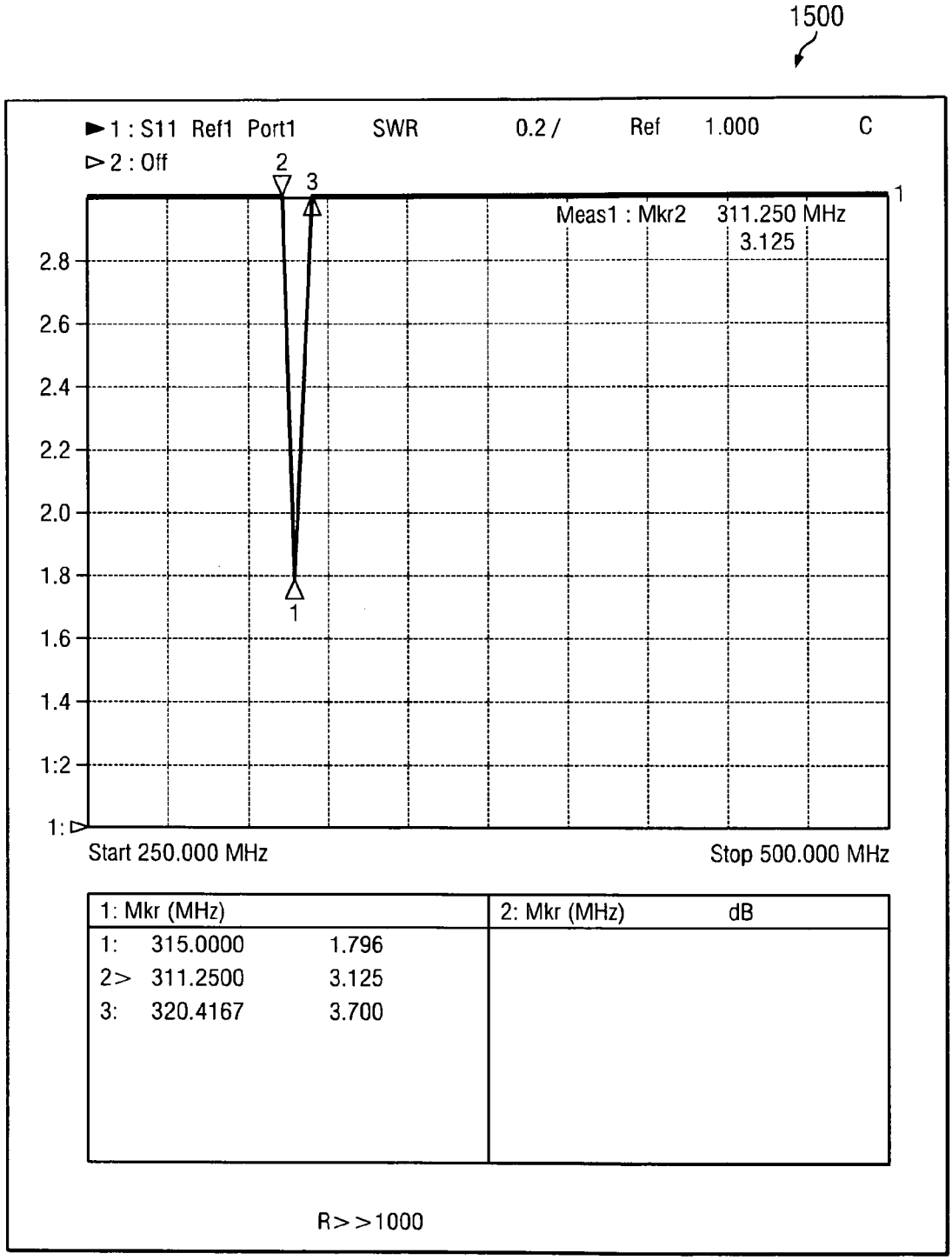
FIG. 15 illustrates a graph of the measurement of a symmetrical printed meander dipole antenna with zero resistance according to an embodiment of the present invention.
Figure 16:
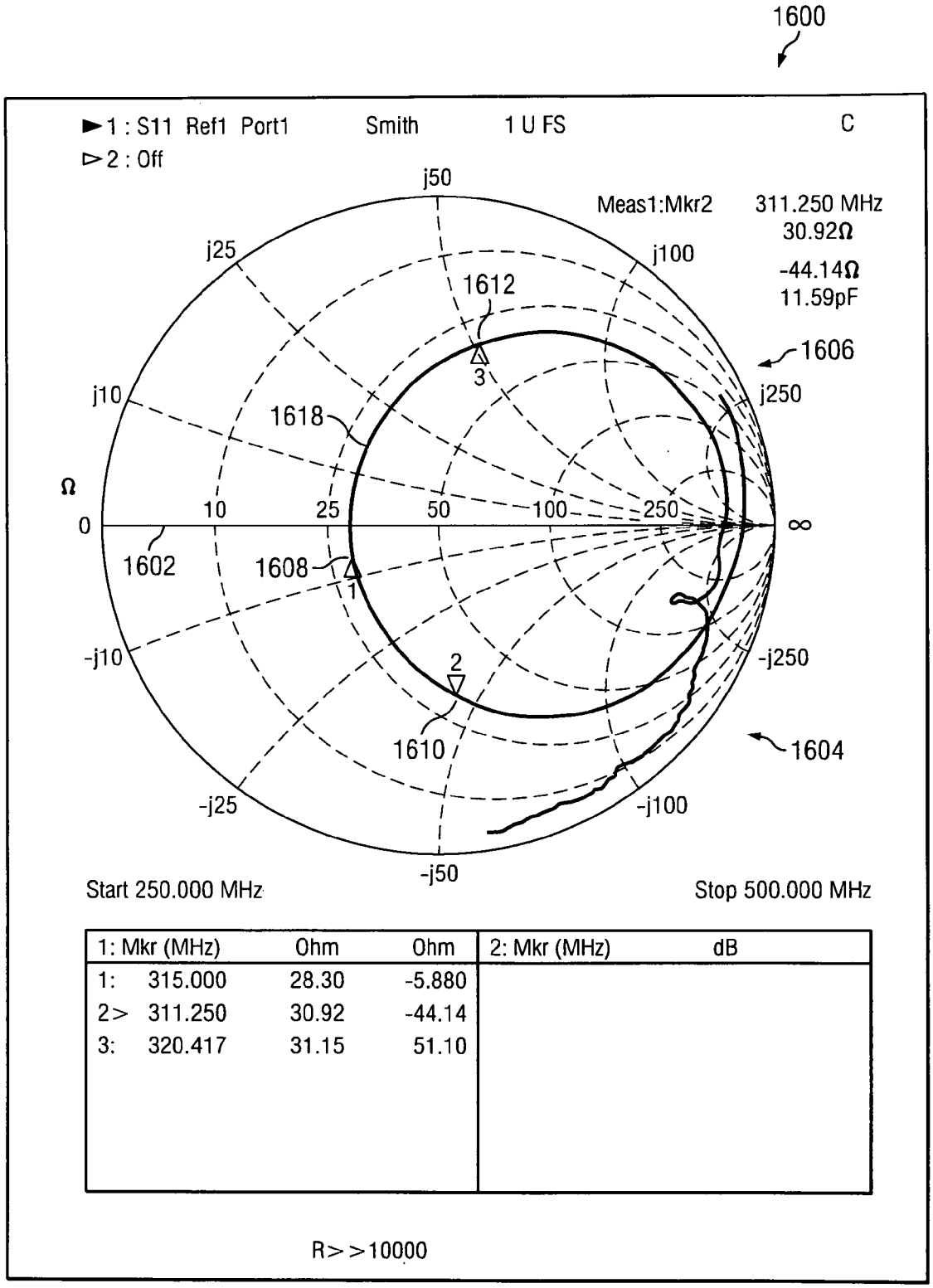
FIG. 16 is a Smith chart used for displaying an exemplary impedance plot that shows the impedance of a symmetrical printed meander dipole antenna with zero resistance according to an embodiment of the present invention.
Figure 17:
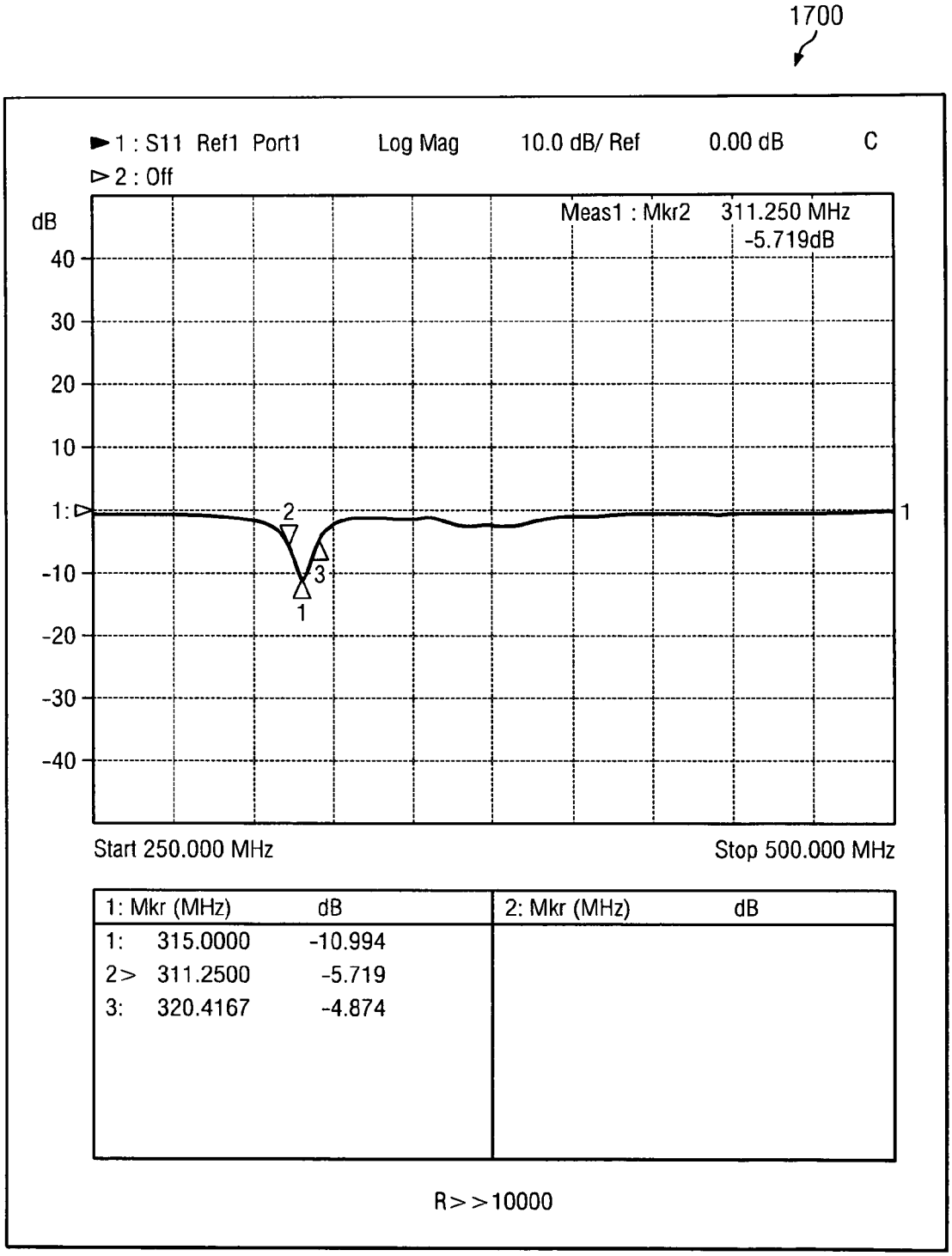
FIG. 17 is a log plot of the of data of FIGS. 15 and 16.

Resistors 418, 518, 618, and 718 may be used in symmetrical printed meander dipole antennas 400, 500, 600, and 700, respectively, to increase the range of frequency bandwidth as described above. Referring to FIG. 15, a graph 1500 shows a symmetrical printed meander dipole antenna with resistance equal to 0 Ohms. As can be seen from graph 1500, the measurement of the frequency bandwidth is approximately 9 MHz, beginning at 311.25 MHz and ending at 320.4167 MHz. Referring to FIG. 16, a Smith chart 1600 is shown that is used for displaying an exemplary impedance plot 1618 for a symmetrical printed meander dipole antenna. In designing a RKE signal path, for example, a network analyzer that is capable of generating the Smith chart 1600 may be used to analyze impedances over an RKE frequency range. As shown on the Smith chart 1600, the input impedance plot 1618 shows input impedances of a symmetrical printed meander dipole antenna having an impedance of 50 Ohms. Because the symmetrical printed meander dipole antenna and RF circuit may be mismatched in impedance, a VSWR value is greater than 1 results. A Smith chart has a normalized impedance plane 1602 defining an inductive impedance (positive imaginary parts) 1606 above the normalized impedance plane 1602 and a capacitive impedances (negative imaginary parts) 1604 below the normalized impedance plane 1602. In Smith chart 1600, a marker 1608 shows an impedance or resistance of 28.30 Ohms at 315 MHz. A marker 1610 shows an impedance of 30.92 Ohms at 311.250 MHz and a marker 1612 shows an impedance of 31.15 Ohms at 320.417 MHz. As understood in the art, if the input impedance of the symmetrical printed meander dipole antenna were to match the RF circuit impedance at 50 Ohms at 315 MHz, the input impedance plot 1618 would cross at or near 50 Ohms at marker 1608 with little imaginary component. Referring to FIG. 17, a log plot 1700 is shown corresponding to the data of FIGS. 15 and 16.

Figure 18:
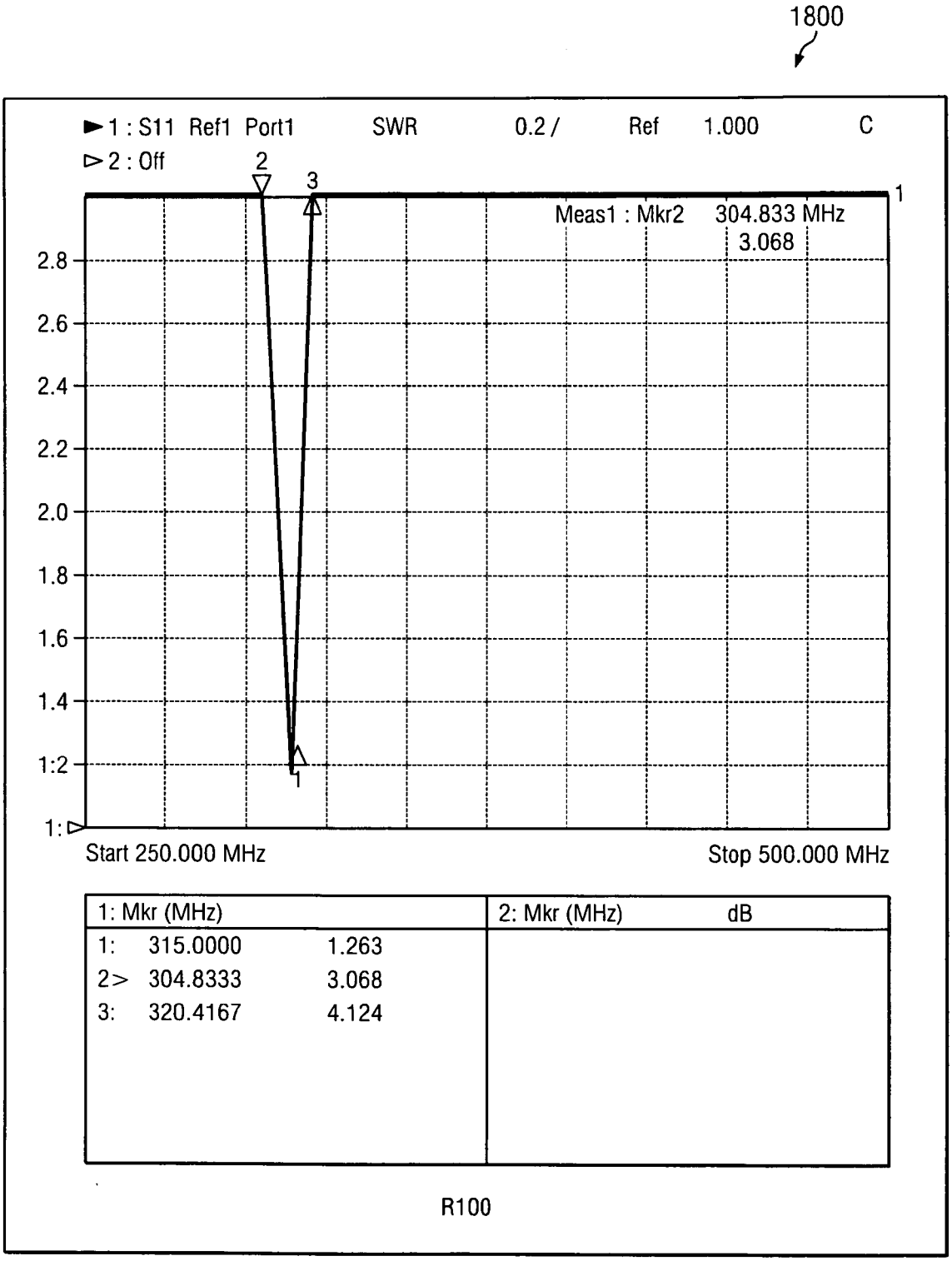
FIG. 18 illustrates a graph of the measurement of a symmetrical printed meander dipole antenna with resistance equal to 100 Ohms according to an embodiment of the present invention.
Figure 19:
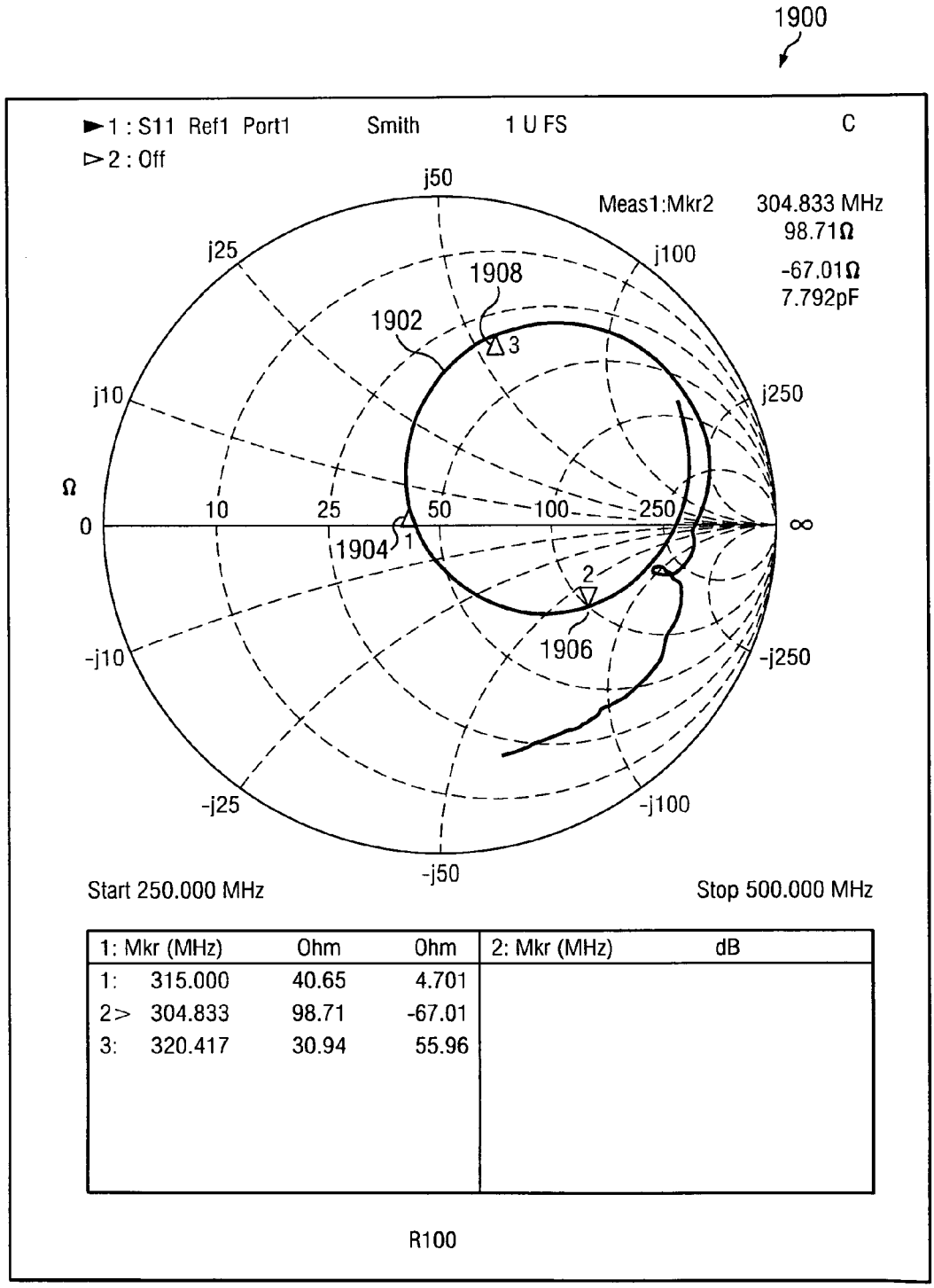
FIG. 19 is a Smith chart used for displaying an exemplary impedance plot that shows the impedance of a symmetrical printed meander dipole antenna with resistance equal to 100 Ohms according to an embodiment of the present invention.
Figure 20:
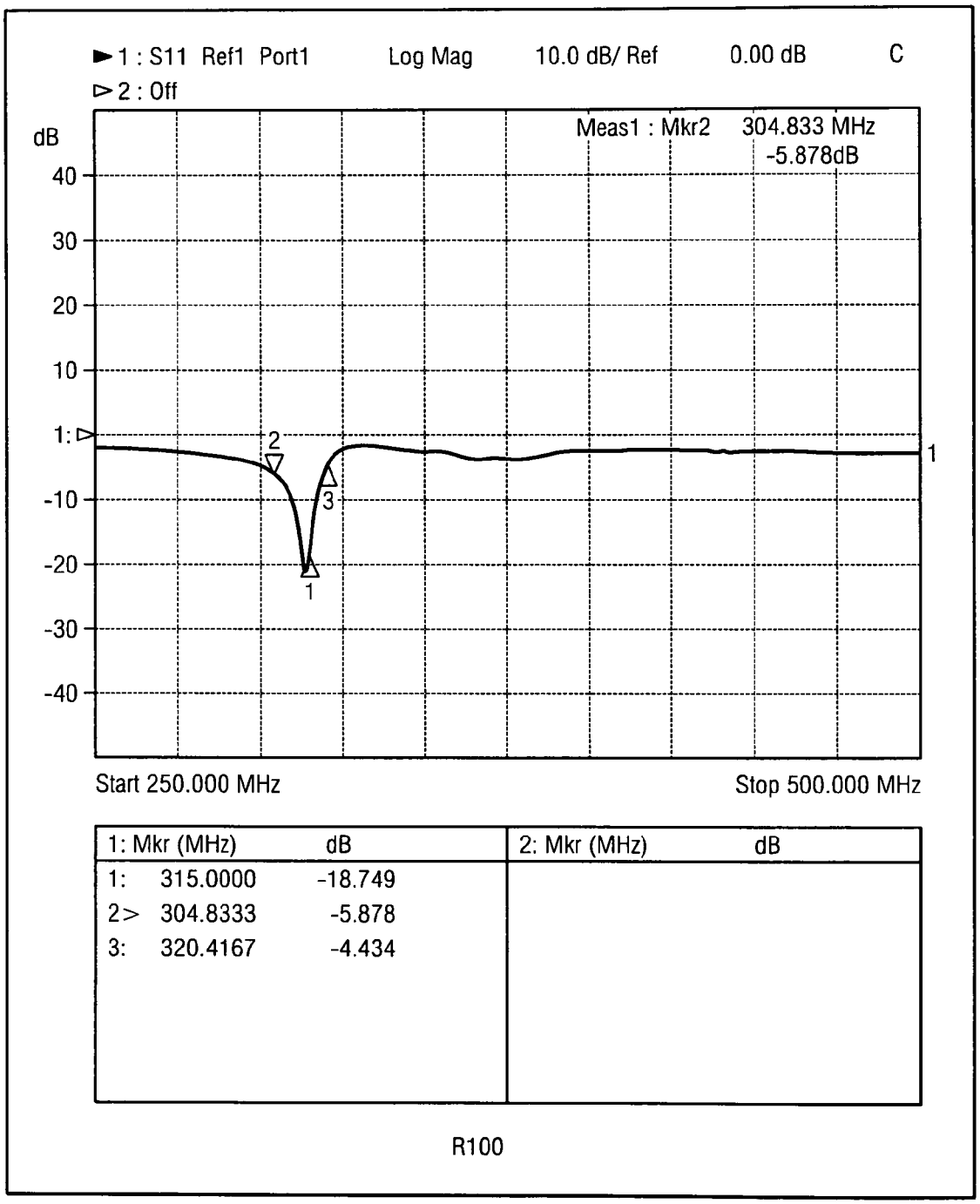
FIG. 20 is a log plot of the of data of FIGS. 18 and 19.

Referring to FIG. 18, a graph 1800 shows a symmetrical printed meander dipole antenna with resistance equal to 100 Ohms. As can be seen from graph 1800, the measurement of the frequency bandwidth is approximately 16 MHz, beginning at 304.8333 MHz and ending at 320.4167 MHz. This is a substantial improvement over the frequency bandwidth with a symmetrical printed meander dipole antenna having zero resistance value as noted in FIG. 15. Referring to FIG. 19, a Smith chart 1900 is shown that is used for displaying an exemplary impedance plot 1902 for a symmetrical printed meander dipole antenna having a resistance of 100 Ohms. In Smith chart 1900, a marker 1904 shows an impedance or resistance of 40.65 Ohms at 315 MHz. A marker 1906 shows an impedance of 30.94 Ohms at 304.8333 MHz and a marker 1908 shows an impedance of 30.94 Ohms at 320.417 MHz. Referring to FIG. 20, a log plot 2000 is shown corresponding to the data of FIGS. 18 and 19.

Figure 21:
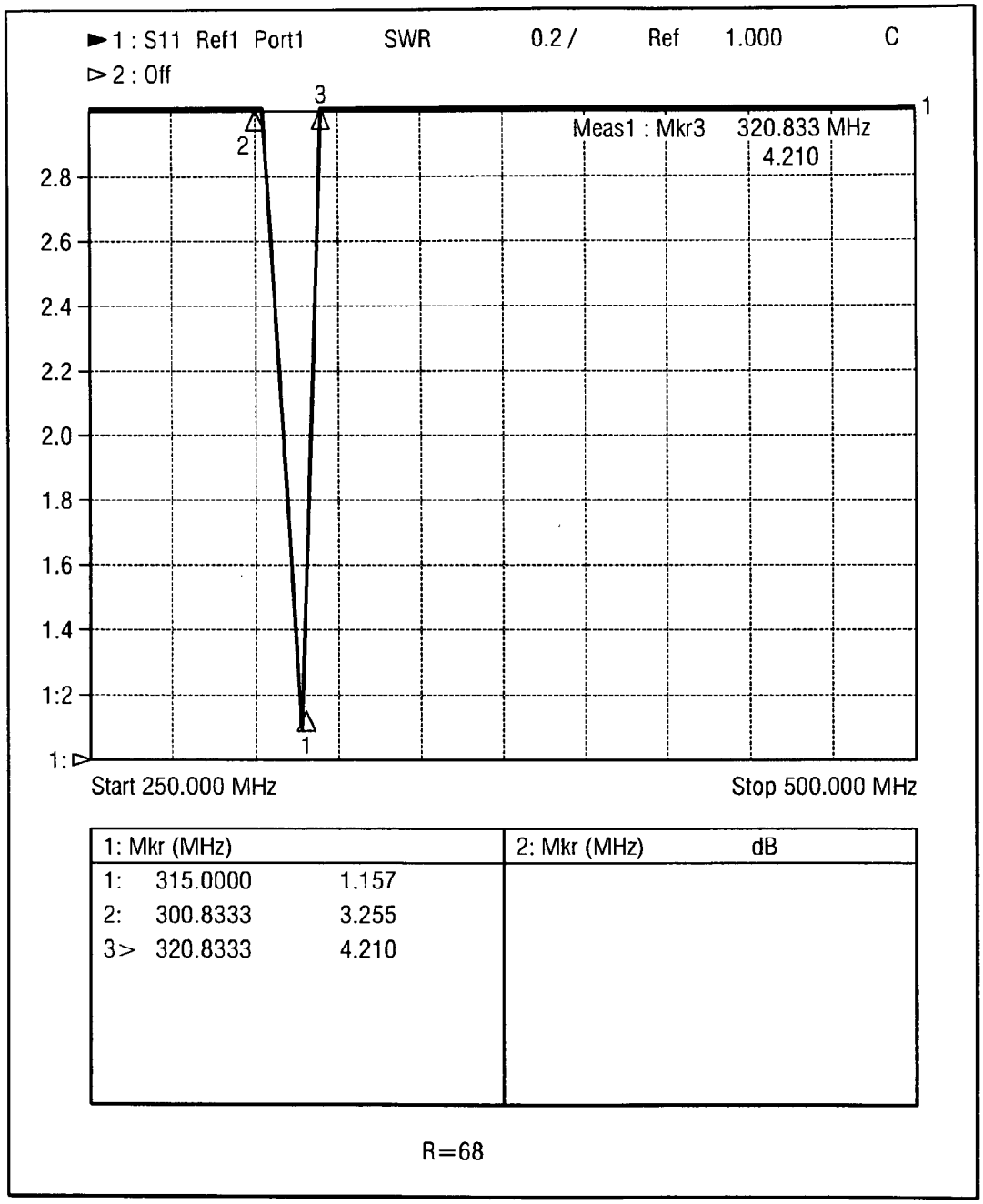
FIG. 21 illustrates a graph of the measurement of a symmetrical printed meander dipole antenna with resistance equal to 68 Ohms according to an embodiment of the present invention.
Figure 22:
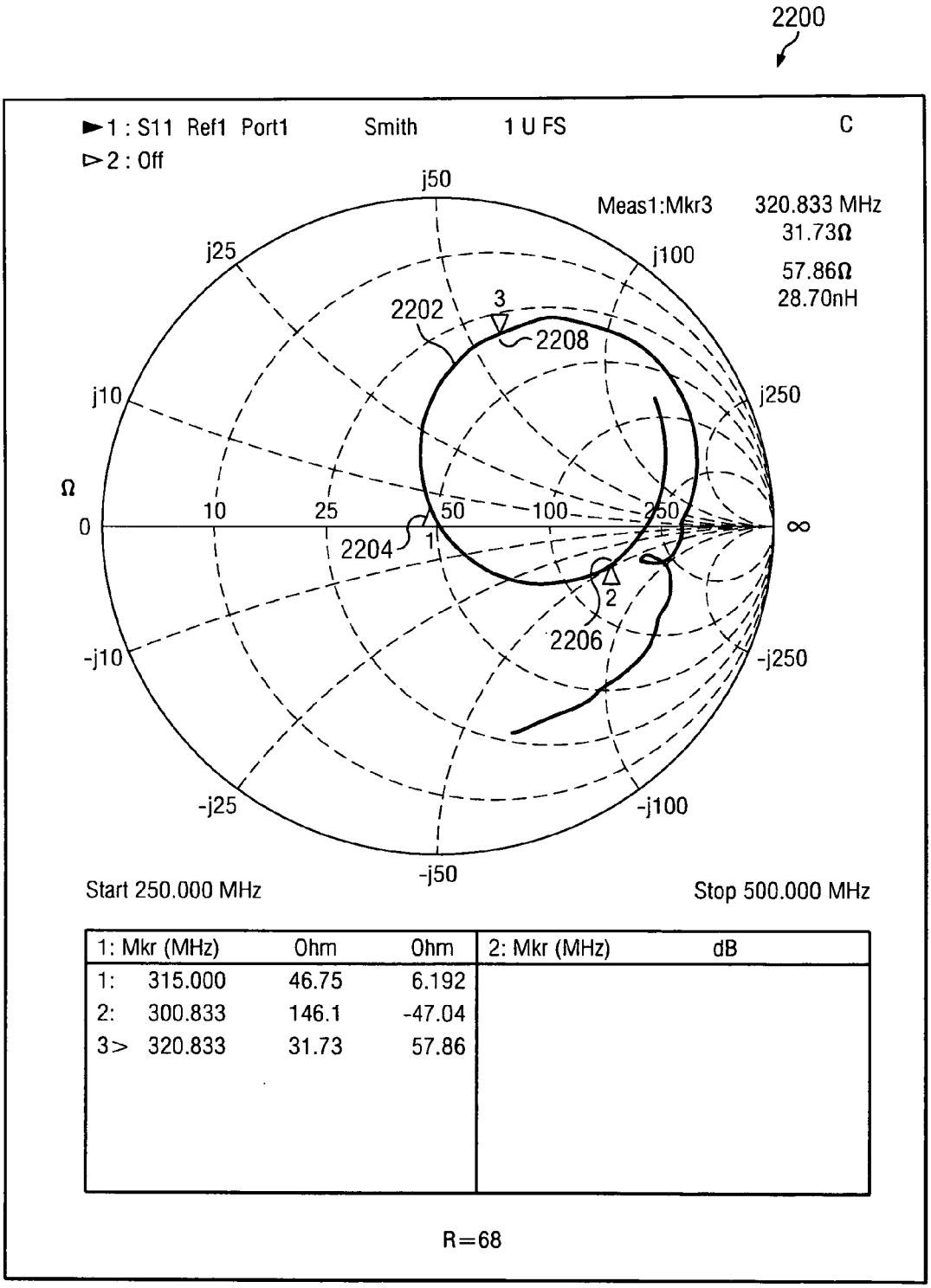
FIG. 22 is a Smith chart used for displaying an exemplary impedance plot that shows the impedance of a symmetrical printed meander dipole antenna with resistance equal to 68 Ohms according to an embodiment of the present invention.
Figure 23:
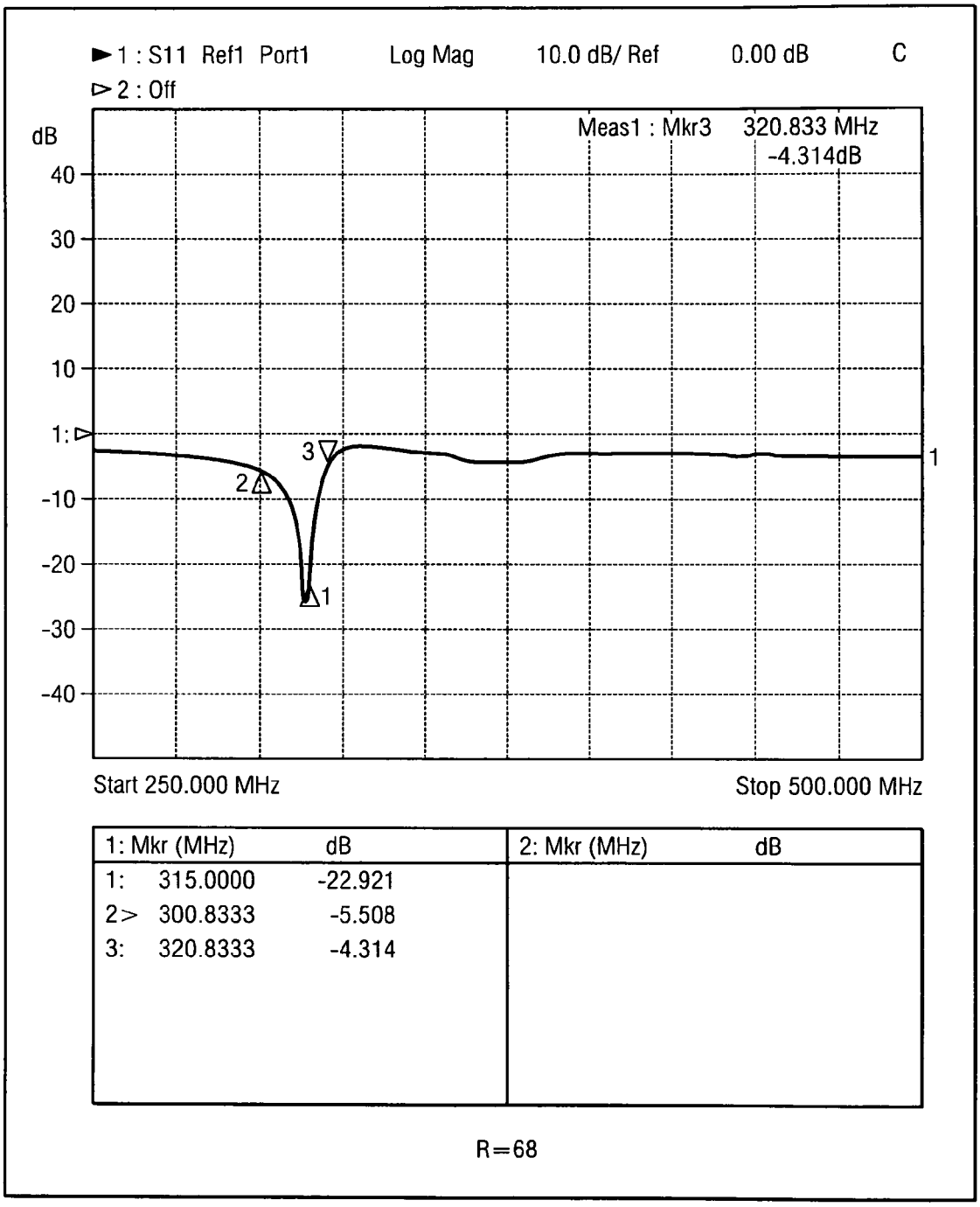
FIG. 23 is a log plot of the of data of FIGS. 21 and 22.

Referring to FIG. 21, a graph 2100 shows a symmetrical printed meander dipole antenna with resistance equal to 68 Ohms. As can be seen from graph 2100, the measurement of the frequency bandwidth is approximately 20 MHz, beginning at 300.8333 MHz and ending at 320.8333 MHz. This is a substantial improvement over the frequency bandwidth with a symmetrical printed meander dipole antenna having zero resistance value and 16 MHz as noted in FIGS. 15 and 16, respectively. Referring to FIG. 22, a Smith chart 2200 is shown that is used for displaying an exemplary impedance plot 2202 for a symmetrical printed meander dipole antenna having a resistance of 68 Ohms. In Smith chart 2200, a marker 2204 shows an impedance or resistance of 46.75 Ohms at 315 MHz. A marker 2206 shows an impedance of 146.1 Ohms at 30.833 MHz and a marker 2208 shows an impedance of 31.73 Ohms at 320.833 MHz. Referring to FIG. 23, a log plot 2300 is shown corresponding to the data of FIGS. 21 and 22.

The previous detailed description is of a small number of embodiments for implementing the invention and is not intended to be limiting in scope. One of skill in this art will immediately envisage the methods and variations used to implement this invention in other areas than those described in detail. The following claims set forth a number of the embodiments of the invention disclosed with greater particularity.

What is claimed:

1. A symmetrical printed meander dipole antenna, comprising:

a dielectric board including a ground plane;

a first antenna trace line disposed on a first portion of the dielectric board and in electrical contact with the dielectric board, the first antenna trace line comprising:

a plurality of first vertical meandered traces;

a second antenna trace line disposed on a second portion of the dielectric board and in electrical contact with the dielectric board, the second antenna trace line comprising:

a plurality second vertical meandered traces, wherein the first and second plurality of vertical meandered traces are symmetrical to each other;

an inductor in contact with the first and second antenna trace lines;

a first plurality of asymmetrical edge meandered antenna trace lines in contact with the first antenna trace line and a second plurality of asymmetrical edge meandered antenna trace lines in contact with the second antenna trace line, the inductor and first and second edge meandered antenna trace lines for tuning the impedance of the symmetrical printed meander dipole antenna; and a resistor in electrical contact with a combined output of the first antenna trace line and the second antenna trace line for providing frequency bandwidth.

2. The symmetrical printed meander dipole antenna according to claim 1, wherein the first and second plurality of vertical meandered traces are symmetrical to each.

3. The symmetrical printed meander dipole antenna according to claim 1, further comprising:

a first output in contact with the first antenna trace line and a second output in contact with the second antenna trace line for outputting electrical signals to a connector.

4. The symmetrical printed meander dipole antenna according to claim 1, wherein the width of the plurality of first vertical meandered traces and plurality of second vertical meandered traces is from about 17 mm to about 33 mm.

5. The symmetrical printed meander dipole antenna according to claim 1, wherein the length of the plurality of first vertical meandered traces and plurality of second vertical meandered traces is from about 70 mm to about 120 mm.

6. The symmetrical printed meander dipole antenna according to claim 1, wherein the width of the plurality of first vertical meandered traces and first plurality of asymmetrical edge meandered antenna trace lines is approximately 54 mm.

7. The symmetrical printed meander dipole antenna according to claim 1, wherein each of the plurality of first vertical meandered traces and the plurality of first vertical meandered traces is from about 16 to about 20 meandered traces.

8. The symmetrical printed meander dipole antenna according to claim 1, wherein the dielectric board is a FR-4 dielectric substrate.

9. The symmetrical printed meander dipole antenna according to claim 1, wherein the resistor has a value of from about 0 to about 100 Ohms.

10. The symmetrical printed meander dipole antenna according to claim 1, wherein the resistor has a value of from about 35 to about 75 Ohms.

11. The symmetrical printed meander dipole antenna according to claim 1, wherein the resistor has a value of approximately 64 Ohms.

12. A vehicle having a symmetrical printed meander dipole antenna, comprising:

a vehicle body;

a symmetrical printed meander dipole antenna disposed on the vehicle body;

a control module disposed on the vehicle body; and a connector connecting the symmetrical printed meander dipole antenna with the control module wherein the symmetrical printed meander dipole antenna comprises:

a dielectric board including a ground plane;

a first antenna trace line disposed on a first portion of the dielectric board and in electrical contact with the dielectric board, the first antenna trace line comprising:

a plurality of first vertical meandered traces;

a second antenna trace line disposed on a second portion of the dielectric board and in electrical contact with the dielectric board, the second antenna trace line comprising:

a plurality second vertical meandered traces, wherein the first and second plurality of vertical meandered traces are symmetrical to each other;

an inductor in contact with the first and second antenna trace lines;

a first plurality of asymmetrical edge meandered antenna trace lines in contact with the first antenna trace line and a second plurality of asymmetrical edge meandered antenna trace lines in contact with the second antenna trace line, the inductor and first and second edge meandered antenna trace lines for tuning the impedance of the symmetrical printed meander dipole antenna; and a resistor in electrical contact with a combined output of the first antenna trace line and the second antenna trace line for providing frequency bandwidth.

* * * * *